US007117812B2

(12) United States Patent
Zimmerman et al.

(10) Patent No.: US 7,117,812 B2
(45) Date of Patent: Oct. 10, 2006

(54) APPARATUS AND METHOD FOR GRAVITY ANCHOR INSTALLATION

(75) Inventors: Evan H. Zimmerman, Houston, TX (US); Matthew W. Smith, Houston, TX (US)

(73) Assignee: Delmar Systems, Inc., Broussard, LA (US)

( * ) Notice: Subject to any disclaimer, the term of this patent is extended or adjusted under 35 U.S.C. 154(b) by 196 days.

(21) Appl. No.: 10/977,960

(22) Filed: Oct. 29, 2004

(65) Prior Publication Data

US 2005/0166825 A1 Aug. 4, 2005

Related U.S. Application Data

(60) Provisional application No. 60/515,744, filed on Nov. 30, 2003.

(51) Int. Cl.
*B63B 21/24* (2006.01)

(52) U.S. Cl. ..... 114/294

(58) Field of Classification Search ..... 114/293–310
See application file for complete search history.

(56) References Cited

U.S. PATENT DOCUMENTS 3,372,665 A * 3/1968 Mesler ..... 114/294
3,631,550 A * 1/1972 Bullen ..... 441/25
6,106,199 A * 8/2000 Medeiros et al. ..... 405/224
6,257,166 B1 * 7/2001 Lieng ..... 114/295

* cited by examiner

*Primary Examiner*—Ed Swinehart

(57) ABSTRACT

Methods for installation, connection to, and use of anchors for mooring of marine structures, especially although not exclusively for gravity installed anchors, and accompanying apparatus. One embodiment comprises an anchor having recovery and load lines attached thereto, both lines held by a trailing buoy and with subsea connectors at their upper ends, held up by the buoy. The trailing buoy is held in a release frame, the anchor is lowered to a desired height above a seabed, then the release mechanism is shifted and the anchor is permitted to free fall and penetrate into the seabed. The trailing buoy and subsea connectors remain above the seabed, and a mooring line from a structure can be connected to the load line via the subsea connector. A second embodiment comprises a launch frame attached to the lowering line. A length of chain or rope is looped from the base of the launch frame to a remote release near the end of the launch frame arm, and from there to a recovery line assembly connected to the anchor. A load line assembly is also connected to the anchor. Once the anchor is lowered to a desired height, the remote release is actuated, and the anchor plunges downward into the seabed. Subsea connectors on both the recovery line assembly and the load line assembly permit attachment and detachment of the lowering line and the mooring line. The apparatus and method of this invention requires only a single vessel and a single deployment line.

11 Claims, 25 Drawing Sheets

FIG. 6
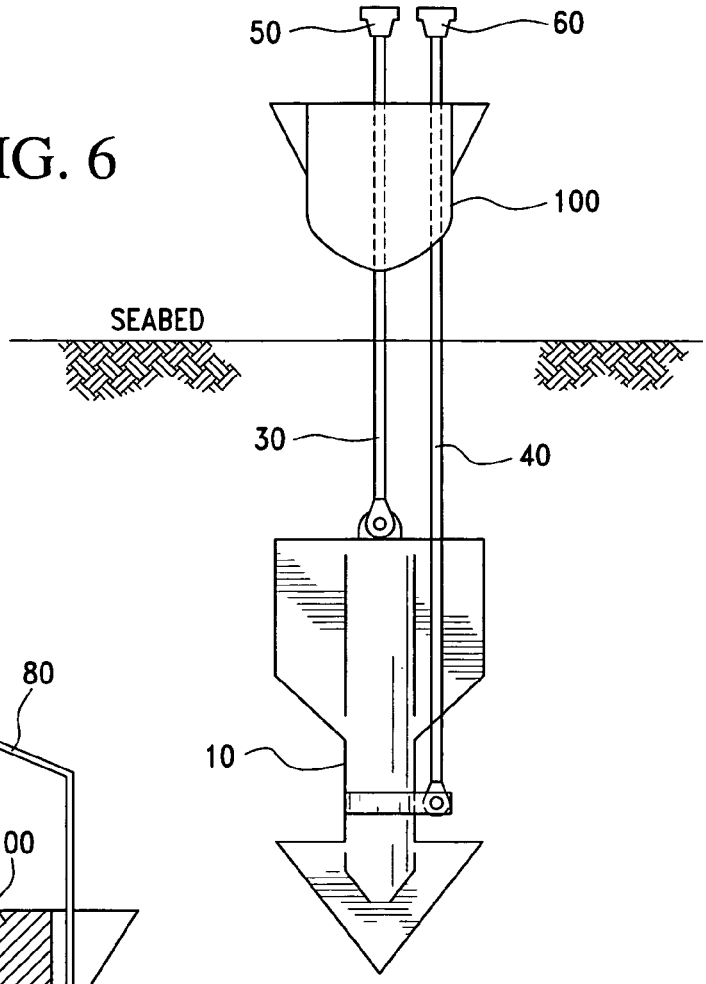
FIG. 7
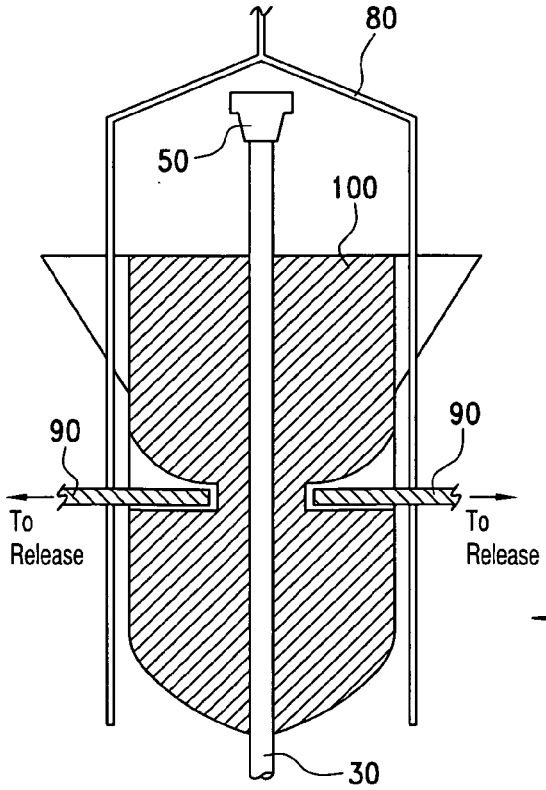
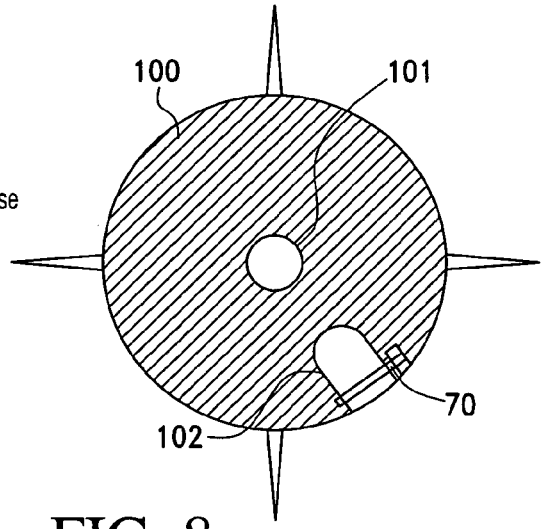
FIG. 8

APPARATUS AND METHOD FOR GRAVITY ANCHOR INSTALLATION

CROSS REFERENCES TO RELATED APPLICATIONS

This application claims priority to provisional patent application Ser. No. 60/515,744, filed Nov. 30, 2003.

BACKGROUND

1. Field of Invention

This invention relates to apparatus and method for mooring of marine structures. With more particularity, this invention relates to methods and apparatus for installation and use of gravity installed anchors, that is, those which embed in a seabed by virtue of being dropped from a height above the seabed and being allowed to fall to the seabed of its own weight.

2. Description of Prior Art

Gravity installed anchors that are installed by freefalling under the force of gravity are known in the art. These anchors are lowered down through the water column to a desired height above the seabed, and then released, whereby their own weight carries the anchor to and into the seabed under the influence of gravity. Examples of existing known examples of gravity installed anchors of this type include U.S. Pat. No. 6,106,199 to Medeiro, Jr. et al (Aug. 22, 2000) and U.S. Pat. No. 6,257,166 to Lieng (Jul. 10, 2001). Prior art methods of installation of these types of anchors are disclosed in those two patents as well. Such methods include a free fall of the anchor, wherein it is simply lowered to a desired height above a seabed then released, with or without a speed limiting device (e.g. a drogue) attached to the anchor; or a procedure wherein the anchor remains connected with the launch vessel via a cable, etc., and the cable is unspooled from the winch, etc. on the launch vessel fast enough that sufficient speed can be developed by the anchor as it falls.

BRIEF DESCRIPTION OF THE DRAWINGS

FIG. 6 shows an anchor embedded in a seabed, showing more detail on the trailing buoy, recovery and mooring lines, etc.

FIG. 7 shows more detail on the release frame and mechanism for the trailing buoy.

FIG. 8 is an end-on view of the trailing buoy.

FIGS. 20–23 are views of this embodiment, showing placement of the anchor in the seabed.

FIGS. 24–27 show steps in connecting a floating marine structure to the anchor.

FIGS. 28–31 illustrate disconnection of the floating marine structure from the anchor, and retrieval of the anchor from the sea bed.

DETAILED DESCRIPTION OF THE PRESENTLY PREFERRED EMBODIMENTS

Figure 1:
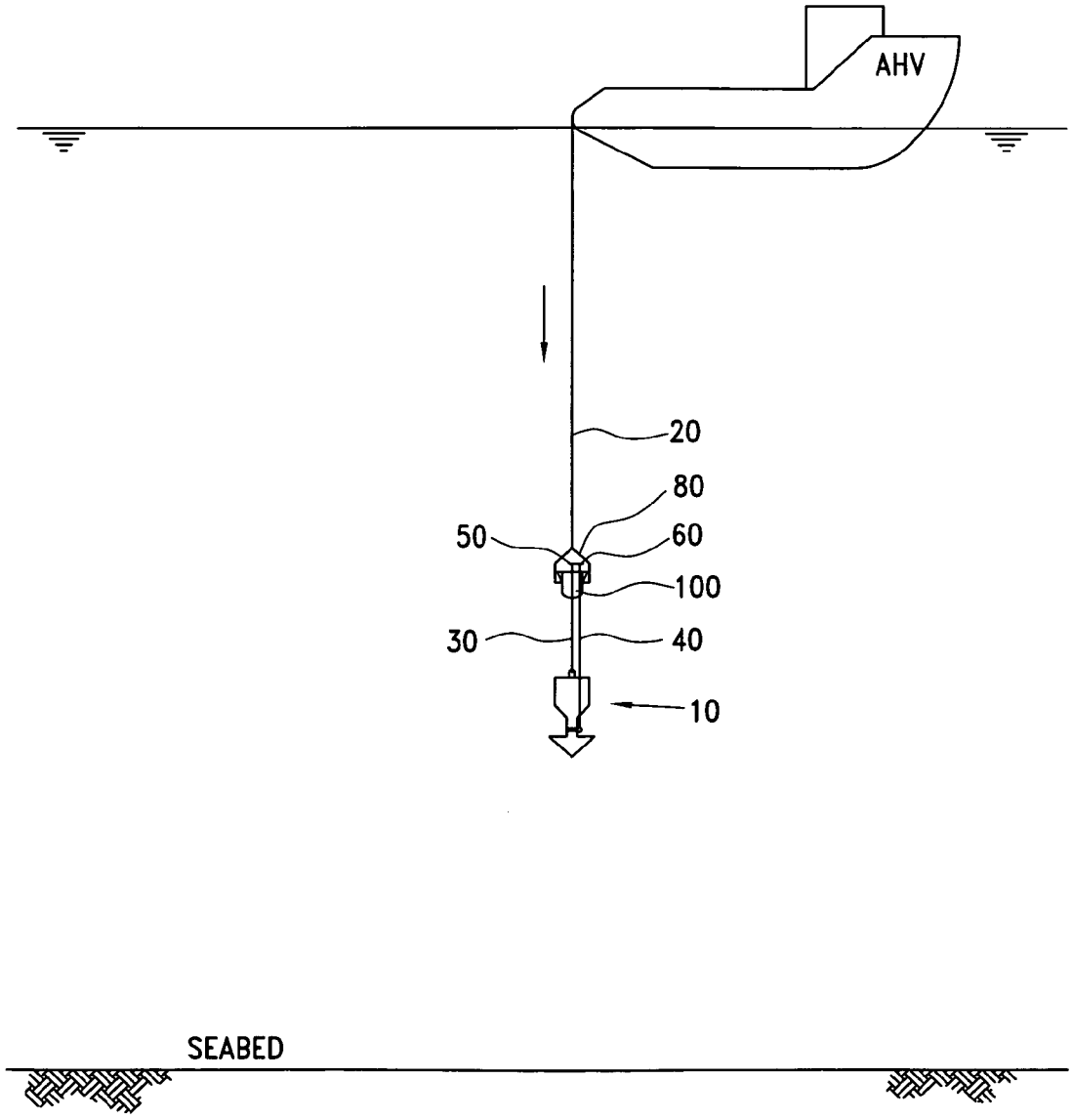
FIGS. 1–5 show a sequence of steps of one embodiment of the installation method of the present invention, with accompanying apparatus to carry out the method.
Figure 2:
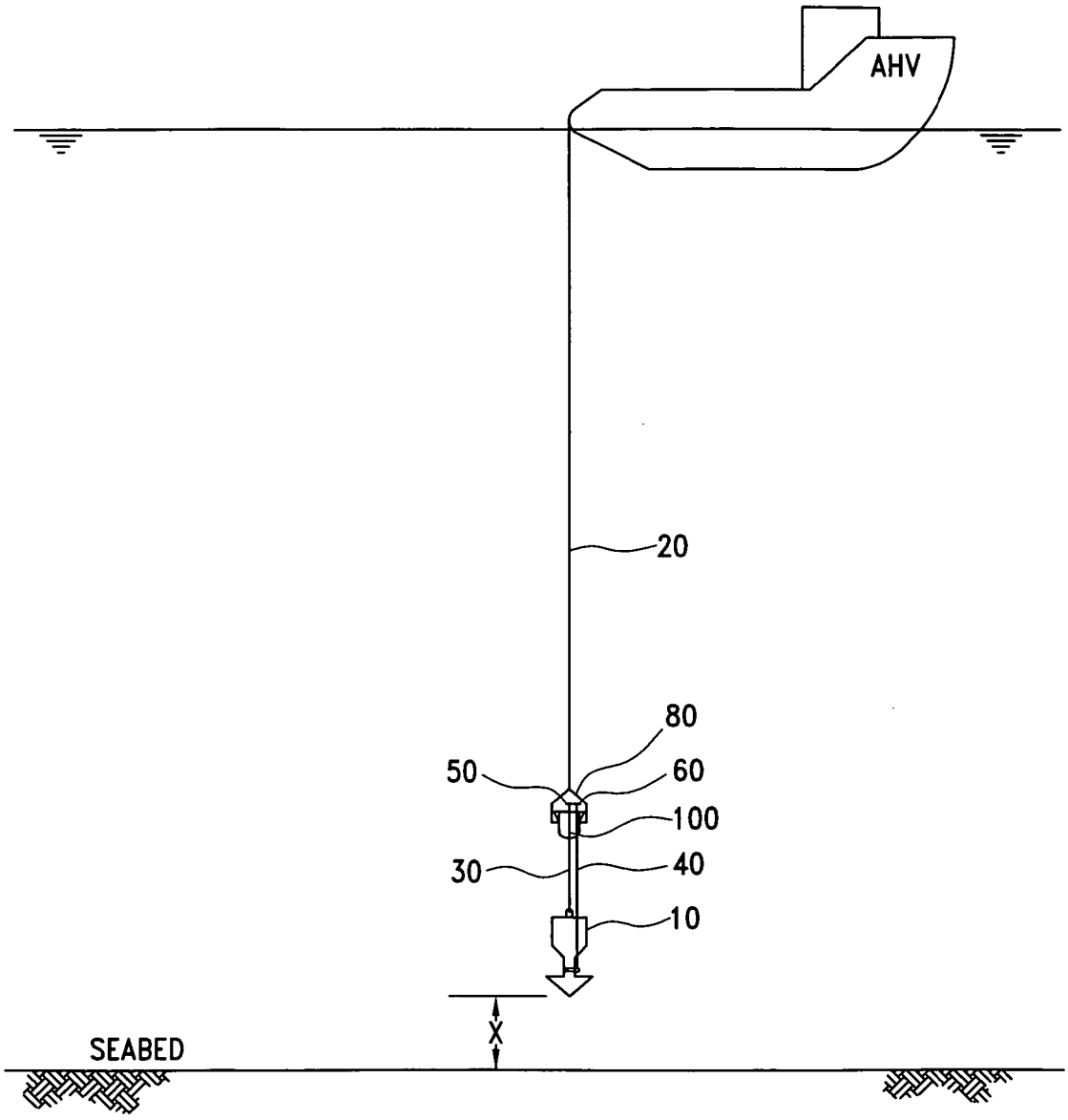
Figure 3:
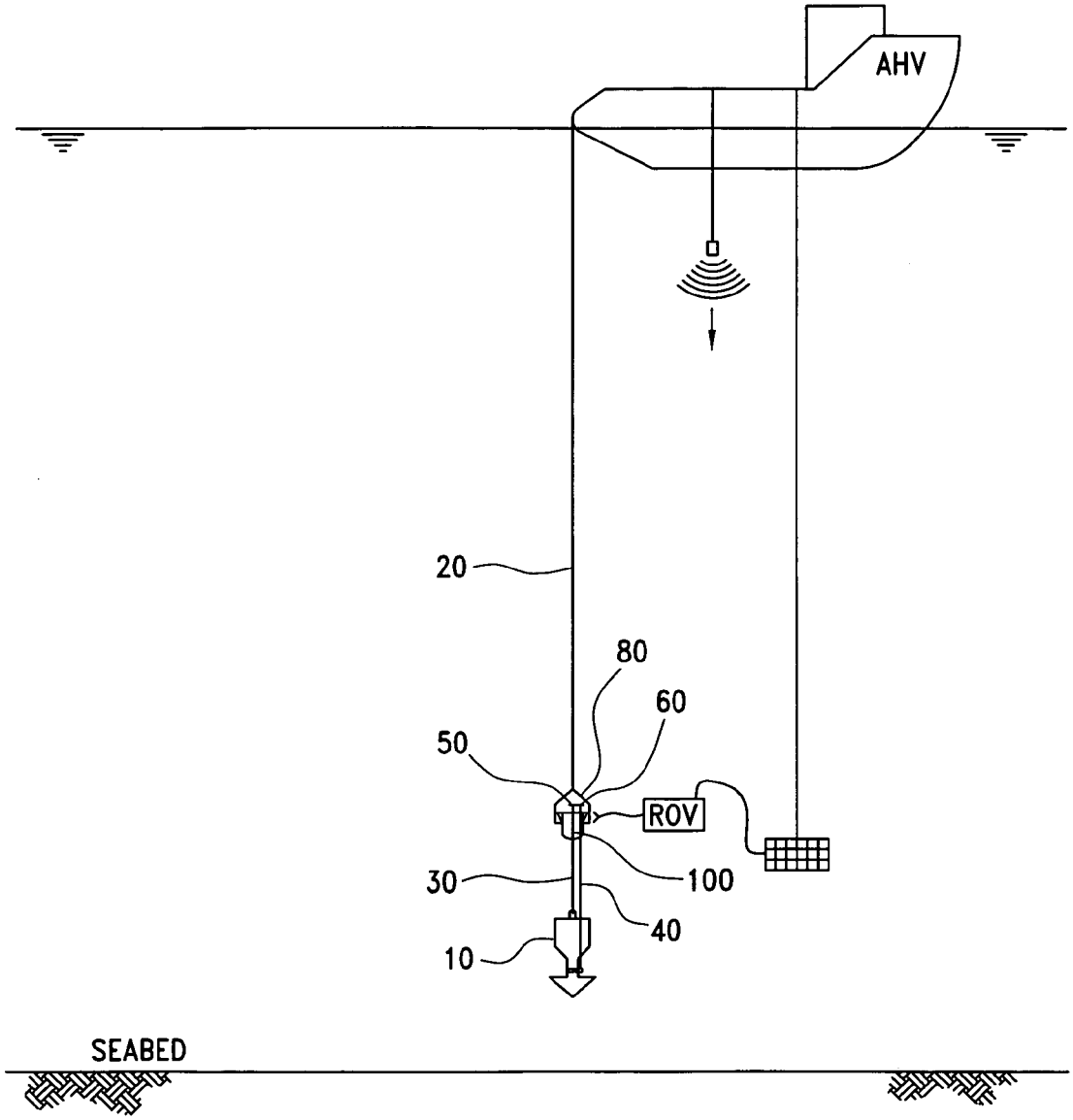
Figure 4:
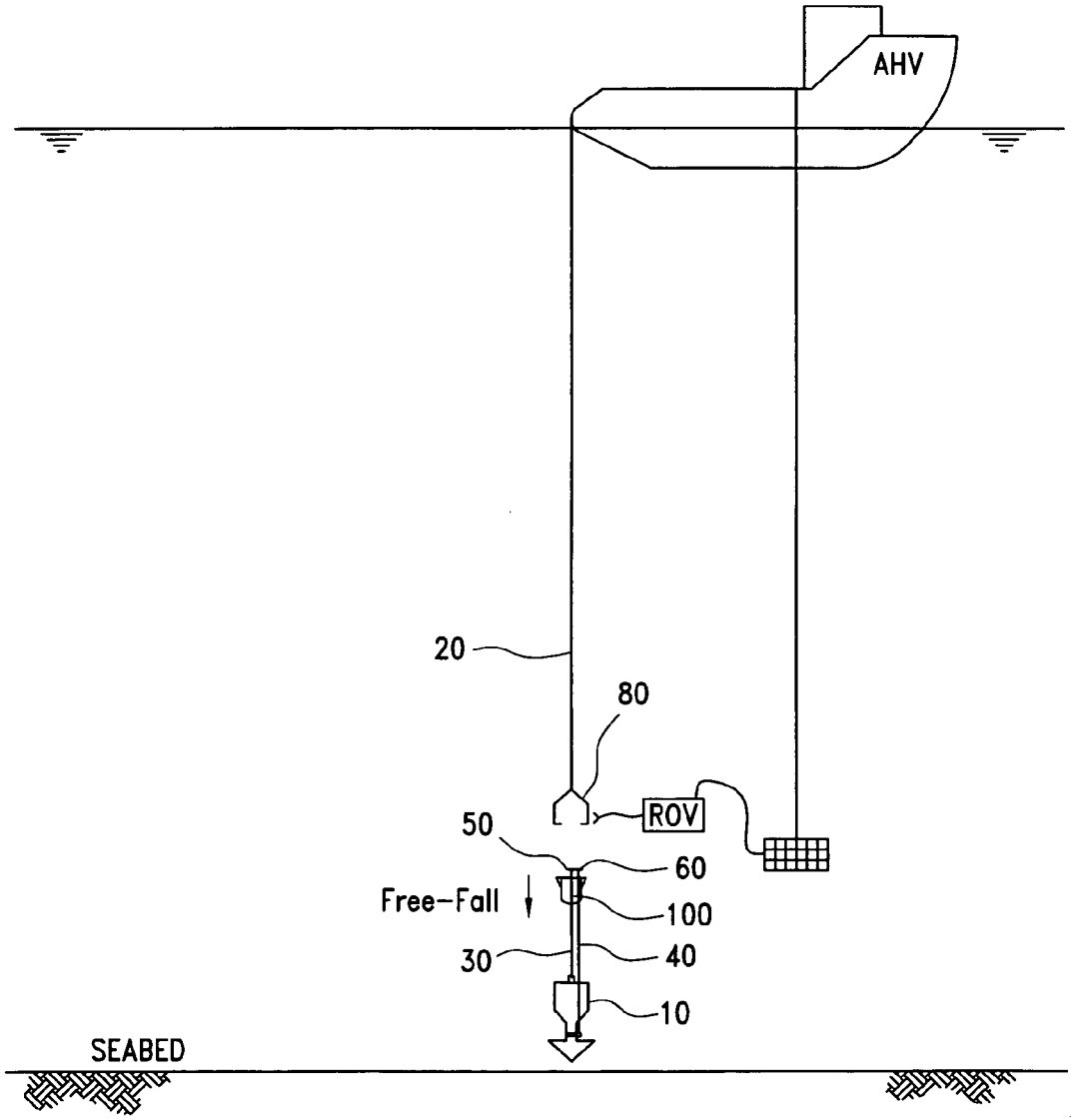
Figure 9:
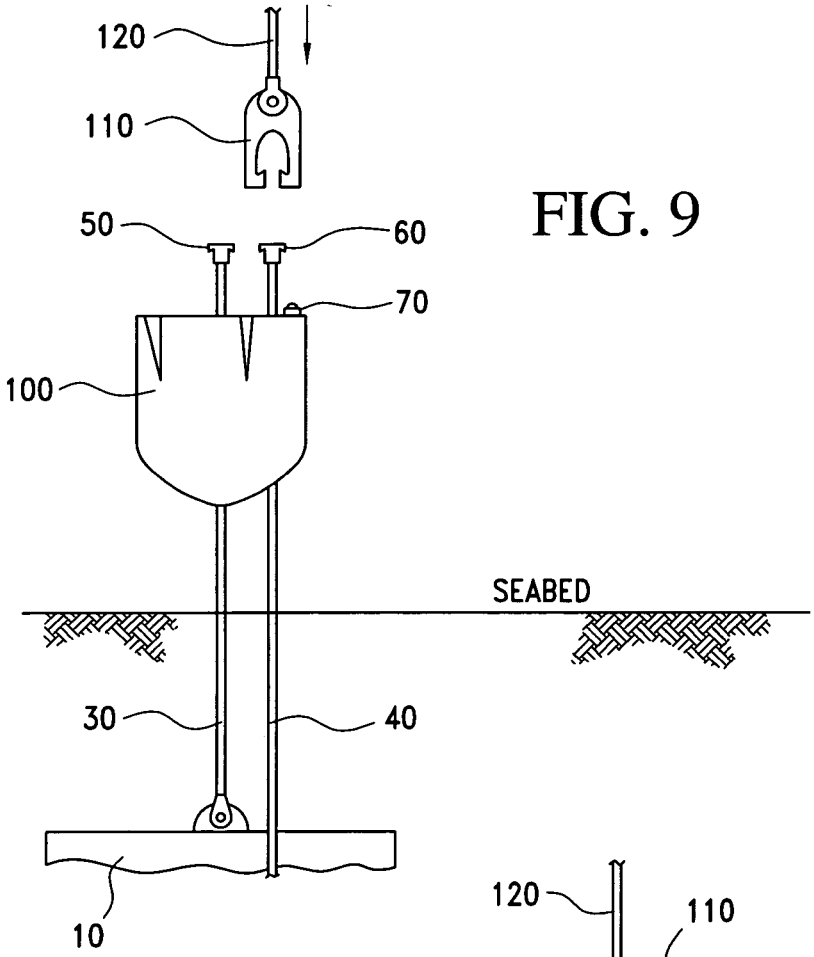
FIGS. 9–13 show a sequence of attaching a floating marine structure to the anchor, with FIG. 11 being a detailed view of the mechanism permitting detachment of the mooring line from the trailing buoy.
Figure 10:
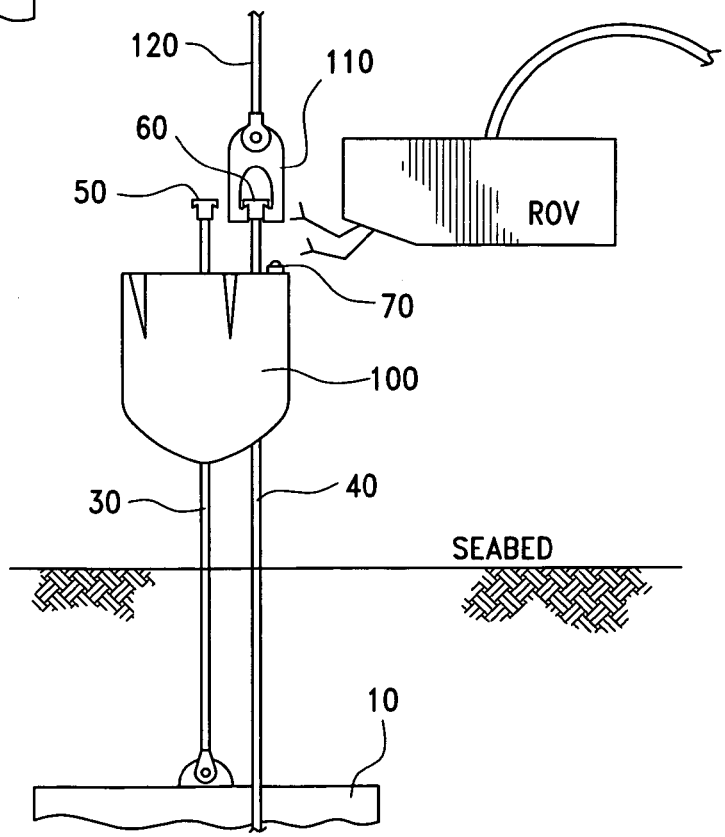

In more detail, and with reference to the appended drawings, some of the presently preferred embodiments of the present invention will now be described. FIGS. 1–19 illustrate a first of the presently preferred embodiments of the apparatus and method of the present invention, which will now be described with reference to those figures. FIG. 1 shows an anchor handling vessel (denoted "AHV") lowering anchor 10 on a lowering line 20. Connected to anchor 10 are a recovery line 30 and a load line 40, as can be seen in FIGS. 1–19, and in more detail in FIG. 6. Recovery line 30 is generally connected to the uppermost end of anchor 10 (as it is oriented as shown in the drawings), and preferably on the longitudinal axis of anchor 10, to ease retrieval of anchor 10 (as is later described). The end of recovery line 30 opposite anchor 10 has connected thereto a subsea connector 50. Subsea connector 50 can take various forms, from a simple eye and hook combination to mating members comprising the dovetail profile as seen in the figures. It is understood that references to "subsea connector" herein (for example, elements 50, 55, 60, 110, 230, 320, and 325) include, without limitation, any type of connection which may be mated together subsea, with or without ROV assistance, and further refer to either "half" (or both together) of a two piece mating connector. Such subsea connectors, as mentioned above, can take the form of a hook inserted through an eye; a pin and clevis; a shackle; or a male/female connector having mating dovetail surfaces as shown in FIGS. 6, 9 and 10; or other types of subsea connectors known in the art.

Load line 40 is connected to anchor 10 preferably at some point along the length of anchor 10, as can be seen in FIG. 6, depending upon the design for mooring purposes. As with the retrieval line, load line 40 has a subsea connector 60 at its end opposite anchor 10. As with the other subsea connector, subsea connector 60 can take various forms, from a simple eye or hook shape to a shape comprising the dovetail profile as seen in the figures.

Both recovery line 30 and load line 40 are held in trailing buoy 100. Recovery line 30 is preferably held centrally located (that is, along the longitudinal axis of anchor 10), as can be seen in FIGS. 6 and 8, while load line 40 is typically releasably held somewhat off-center, as can be seen particularly in FIG. 8. Load line 40 is releasably held in place by a retaining assembly 70, see FIG. 8, which can be manipulated (opened and closed) by an ROV (retaining assembly 70 is described in more detail later).

Figure 5:
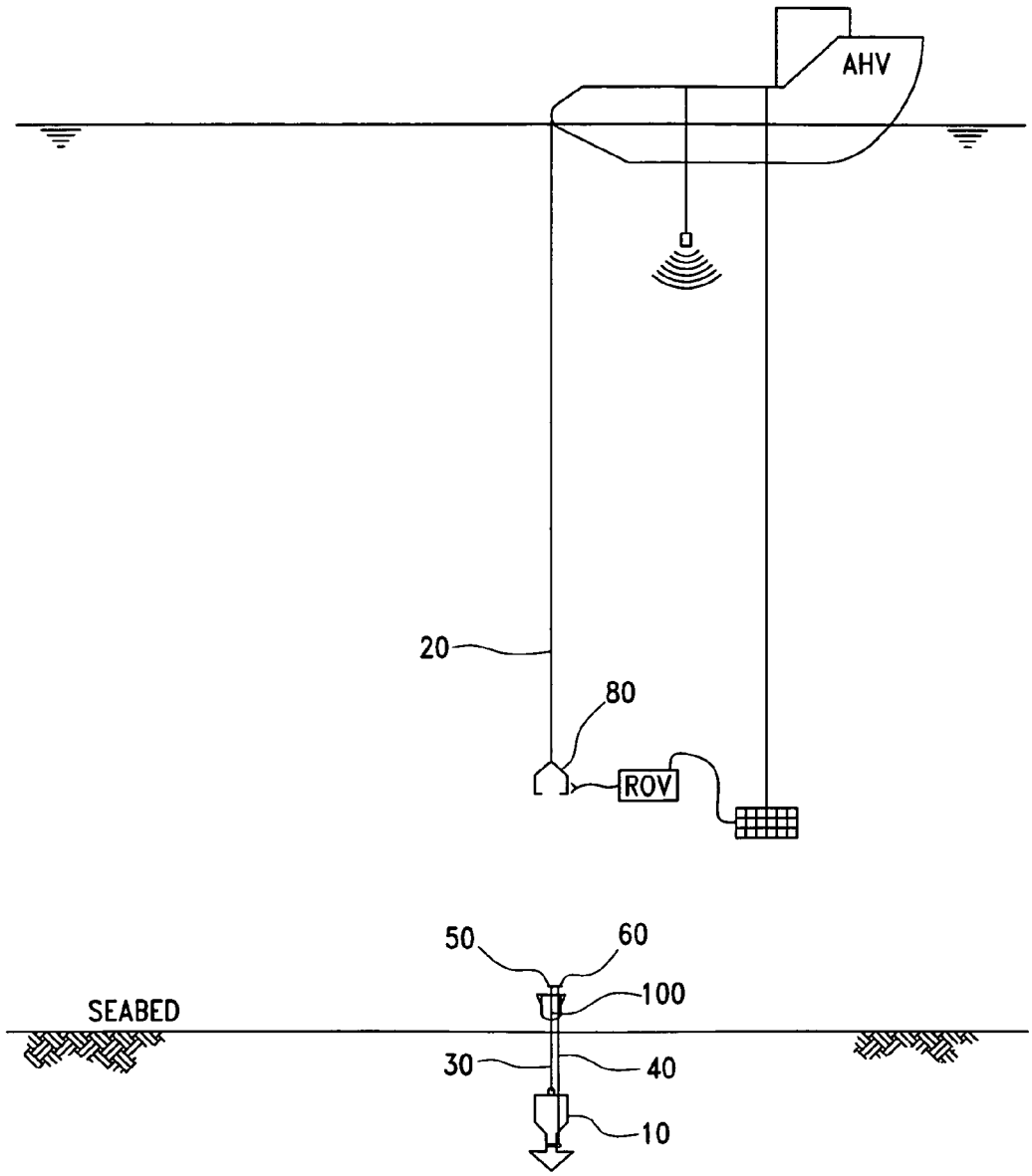

Returning to FIGS. 1 and 2, anchor 10 is lowered to a desired distance X above the seabed. Distance X is calculated, and is a function of the expected soil types, desired penetration depth of the anchor, etc. The entire assembly, including anchor 10, recovery and load lines 30 and 40, and trailing buoy 100, are held by release frame 80. Preferably, trailing buoy 100 is held in release frame 80 by a release mechanism, shown in detail in FIG. 7. When the anchor is at the desired height, an ROV manipulates the release mechanism, FIG. 3, the anchor 10 drops to the seabed in free fall, FIG. 4, and penetrates into the seabed, with trailing buoy 100 with retrieval and load lines 30 and 40 attached thereto floating above the seabed, as seen in FIG. 5. FIG. 6 is further detail of the entire assembly with the anchor embedded.

While various types of ROV-manipulated release mechanisms could be used to release anchor 10 to free-fall, one embodiment is shown in FIG. 7. This comprises one or more pins 90 which are inserted through release frame 80 into trailing buoy 100. Pins 90 can be retracted with the ROV a sufficient distance to clear trailing buoy 100, at which time anchor 10 will free fall.

FIG. 8 shows trailing buoy 100 from an end-on view, showing the longitudinal hole 101 for passage of recovery line 30, and the off-center slot 102 for load line 40 passage. The retaining assembly 70 is also shown.

Figure 11:
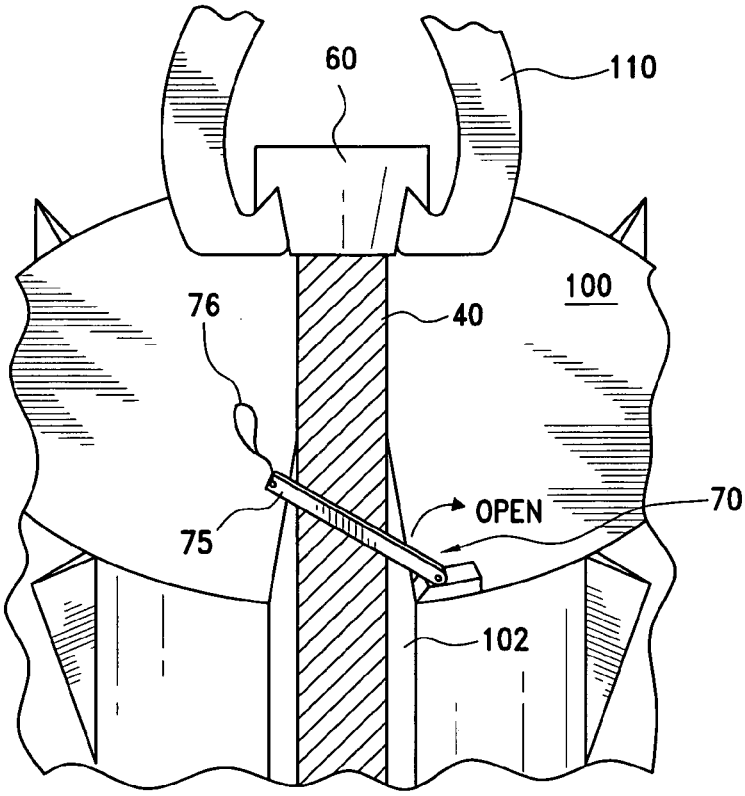
Figure 12:
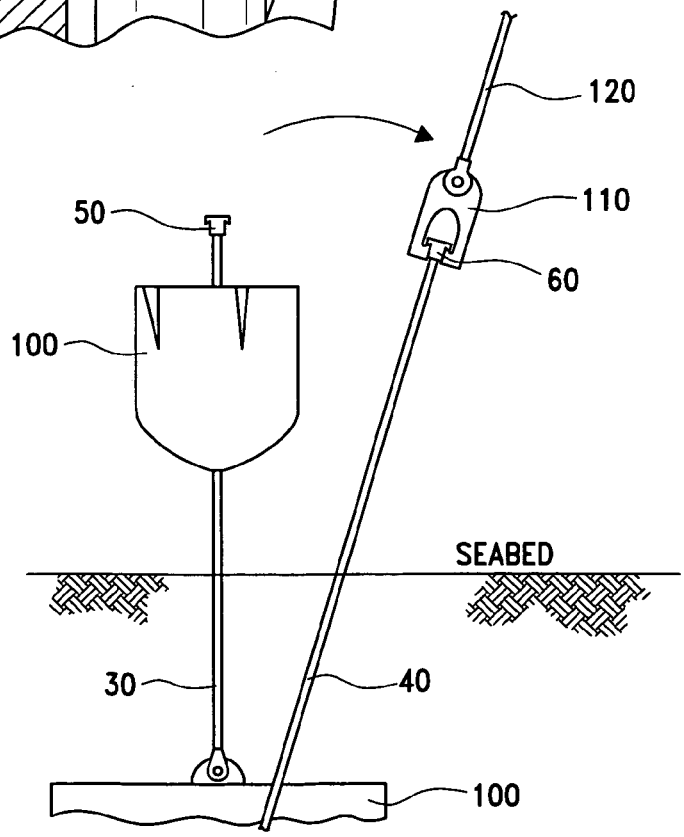
Figure 13:
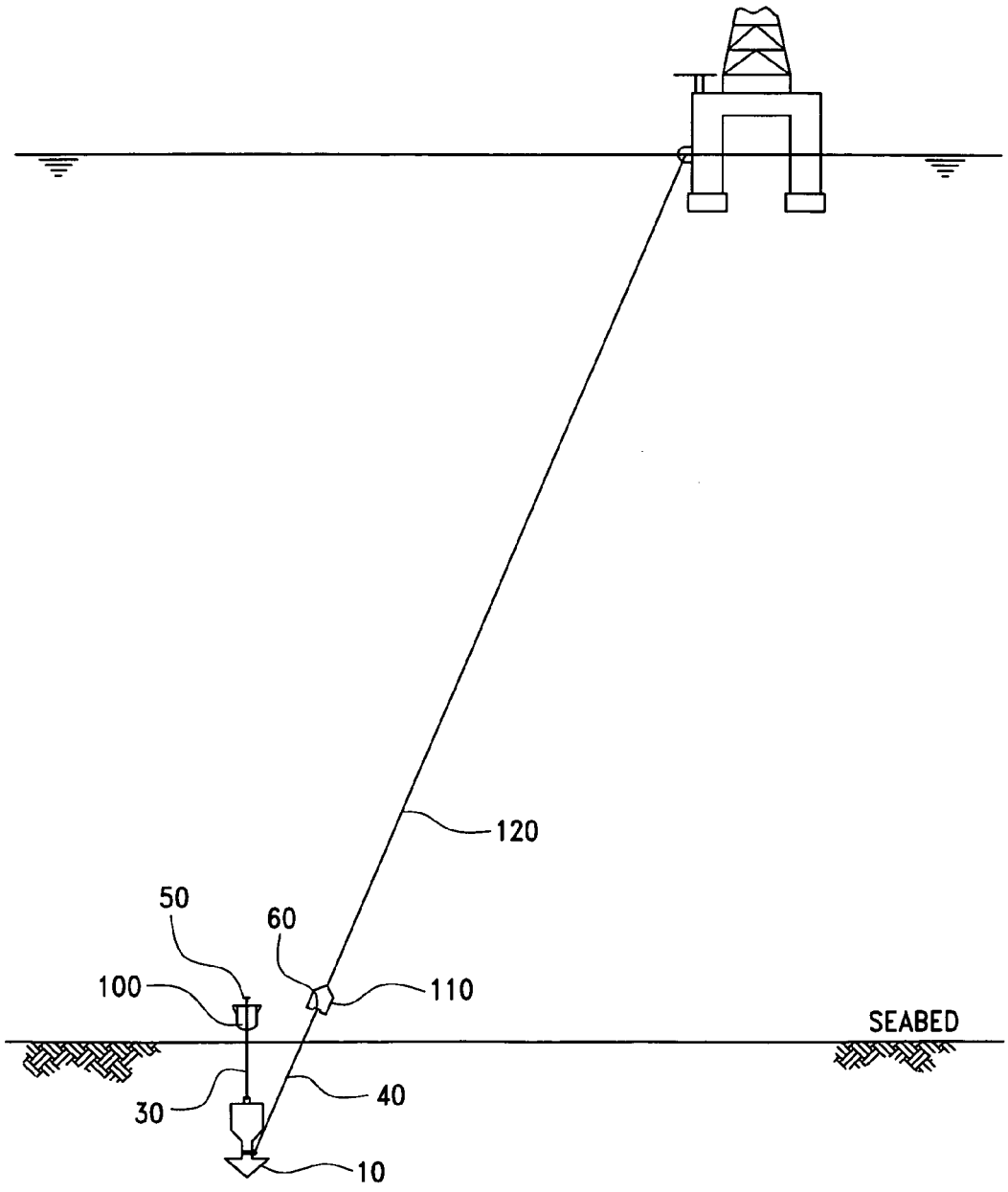

At some desired time, a mooring line 120 from a floating marine structure can be connected to anchor 10, as will be described with reference to FIGS. 9–13. In FIGS. 9 and 10, a mating subsea connector member 110 is lowered to subsea connector 60 (connected to load line 40) and the two parts of the subsea connector are mated together with the assistance of the ROV. In FIG. 11, the release assembly 70 is opened by the ROV (for example, in the embodiment shown, a hinged bar 75 can be moved so as to block access to/from the slot for load line 40, by a lanyard 76 graspable by the ROV), then load line 40 can be moved out of its engagement with trailing buoy 100, into a loaded position, see FIGS. 12 and 13.

Figure 14:
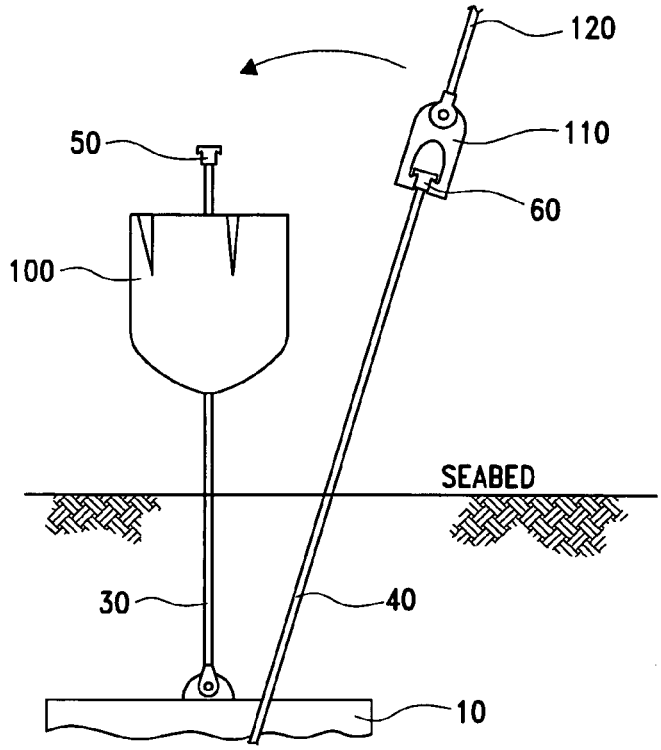
FIGS. 14 and 15 show a sequence of replacement of the mooring line within its slot in the trailing buoy.
Figure 15:
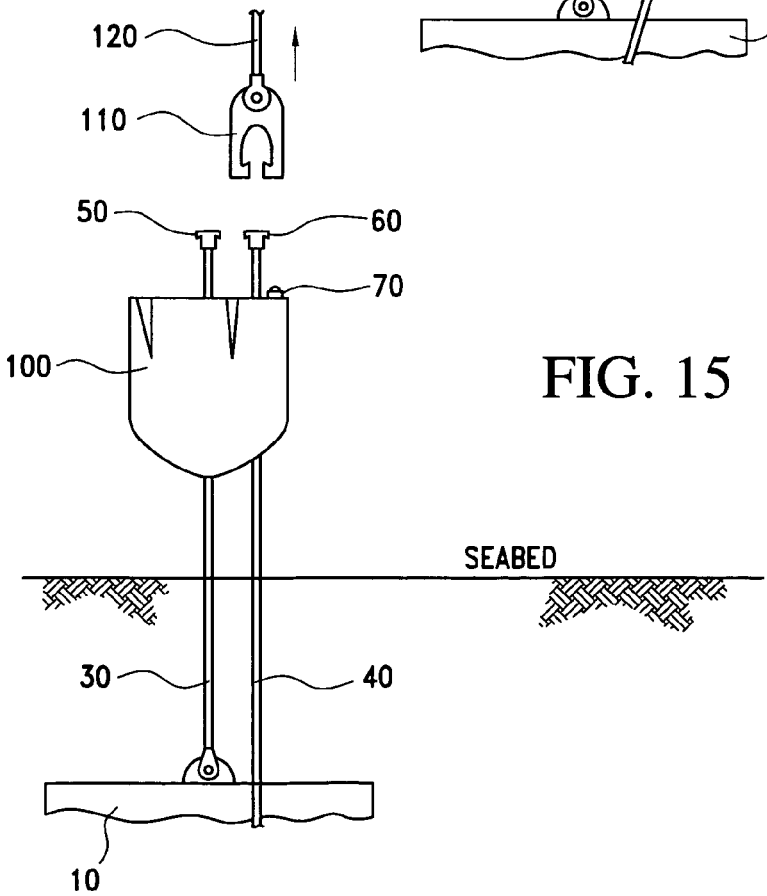
Figure 16:
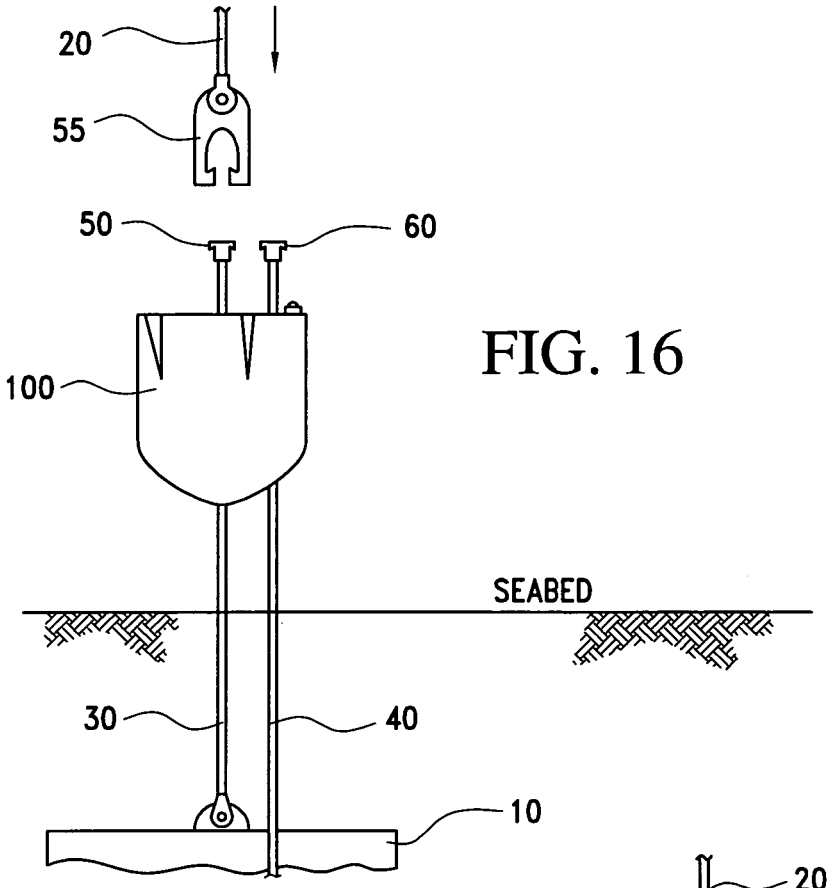
FIGS. 16–19 illustrate the steps in recovery of the anchor.
Figure 17:
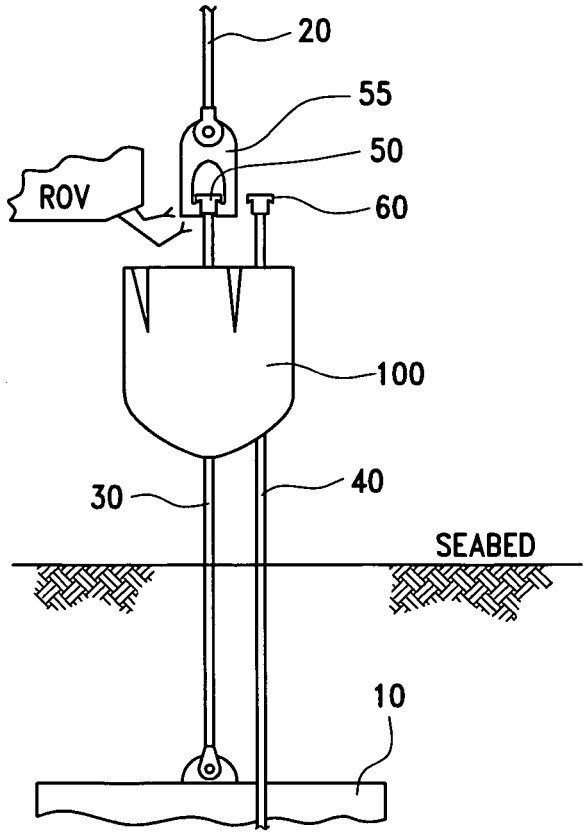
Figure 18:
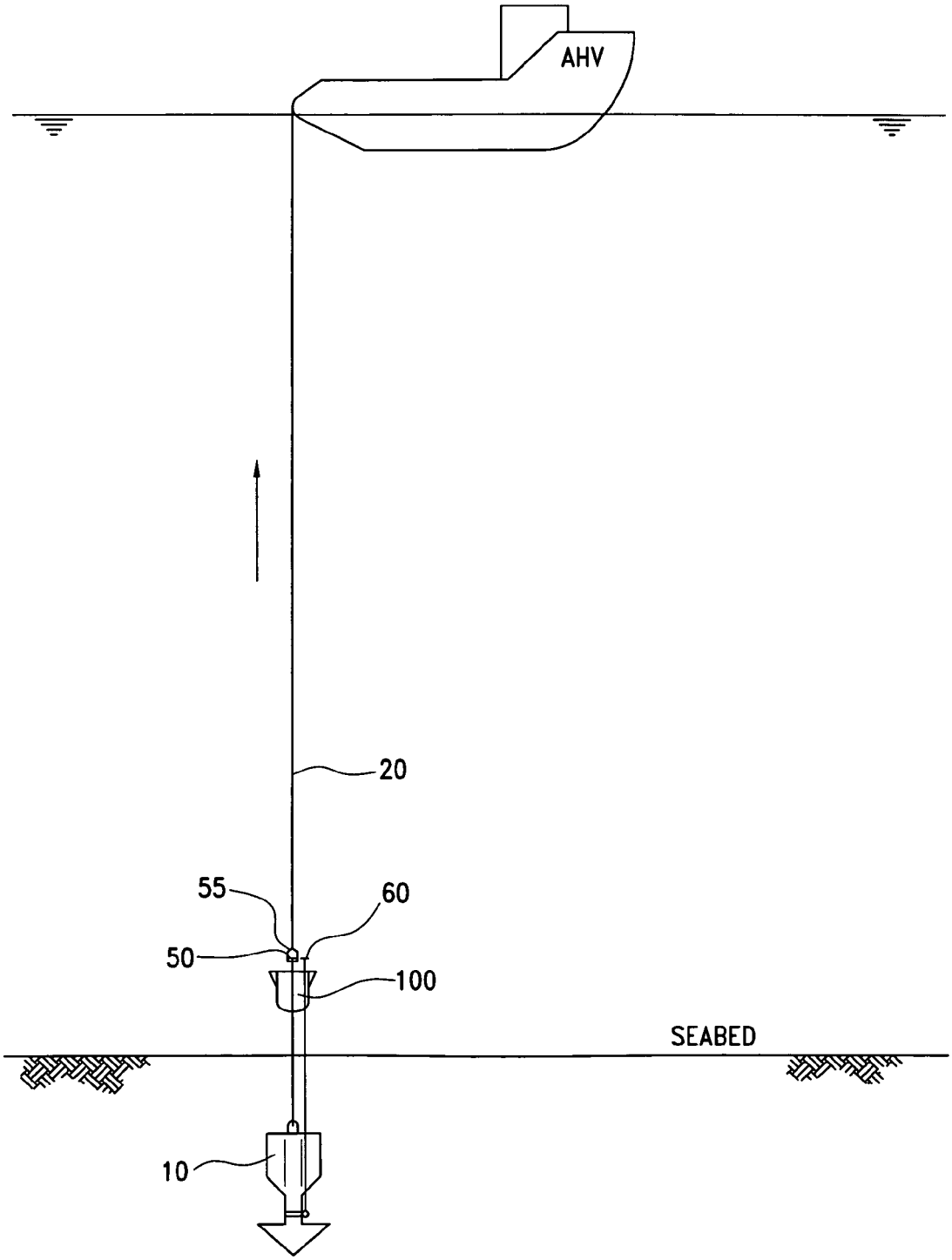
Figure 19:
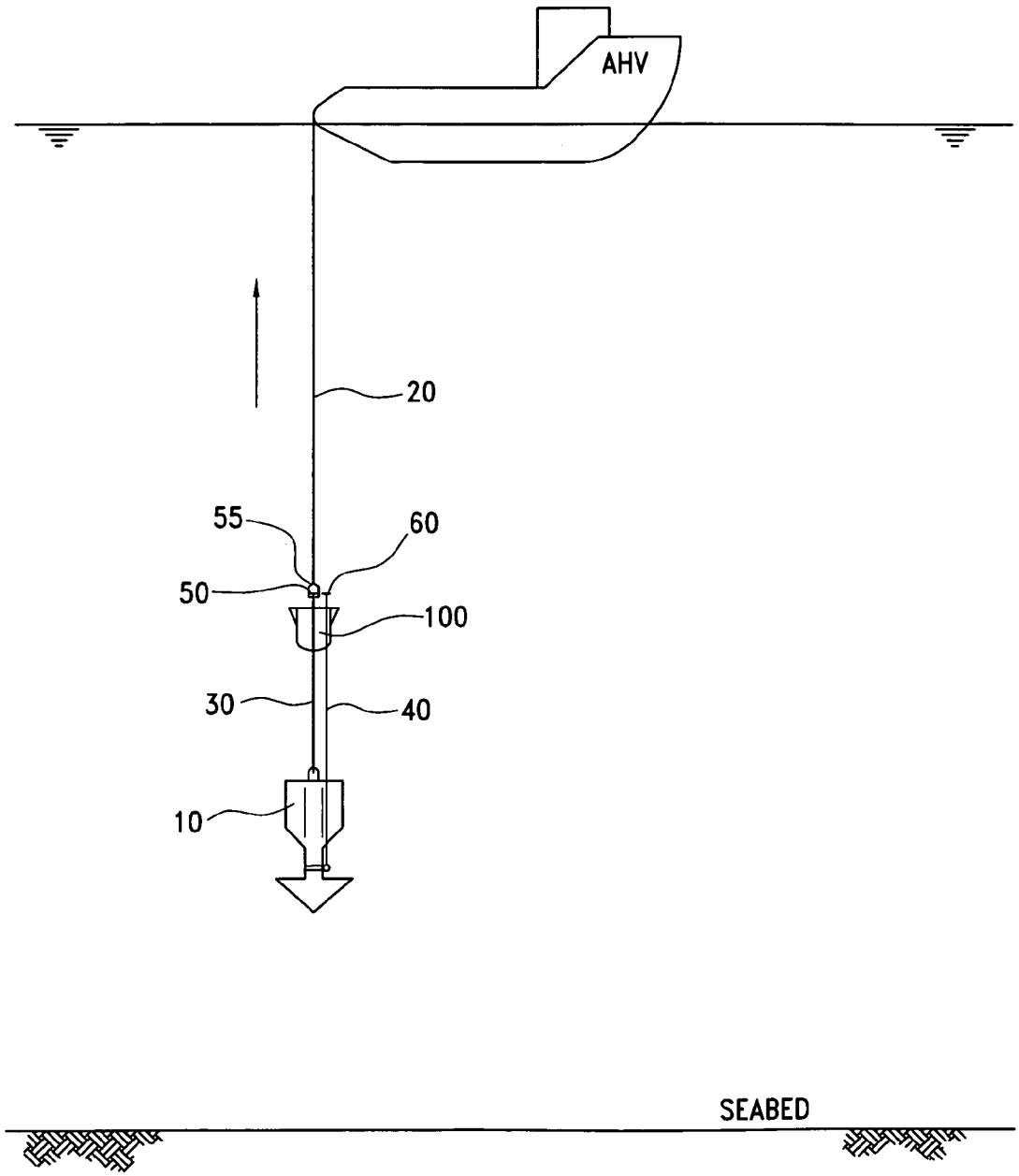

The sequence of steps for detachment of the floating marine structure from anchor 10, and recovery of anchor 10, are for the most part a reversal of the above-described steps for deployment of the anchor. In FIGS. 14 and 15, mooring line 120 is moved so as to move load line 40 back into its slot in trailing buoy 100, and mooring line 120 is disconnected from load line 40. Release assembly 70 is then manipulated so as to retain loading line in its slot. In FIGS. 16 and 17, a lowering line 20 is connected to recovery line 30 via subsea connector 50 mating together with subsea connector 55. FIGS. 18 and 19 show anchor 10 being pulled out of the seabed and back up to the anchor handling vessel.

Another Embodiment of the Invention

With reference to FIGS. 20–31, another embodiment of the apparatus and method of the present invention can be described. Launch frame 200 is connected to lowering line 20. As can be seen in FIGS. 20–24, particularly FIGS. 22–24, lowering line 20 extends to a subsea connector 230, which in turn connects to recovery line assembly 240. Subsea connector 230 can be a simple hook and eye, or various other ROV-manipulable subsea connectors known in the art and as described in detail above. Lowering line 20 preferably includes a length of a torque free flexible member, such as synthetic rope, or in a presently preferred embodiment chain 250, extending from recovery line assembly 240 to a release mechanism 260 disposed on launch frame 200, preferably at a location spaced away from lowering line 20. Preferably, sufficient excess length of the flexible member is provided (as can be seen in the figures, where chain 250 is looped from the base of launch frame to the release mechanism 260) that anchor 10 can free fall the desired distance, without reaching the full extent of the length of chain 250. While release mechanism 260 can take various forms, for example a mechanical release which is operated by a Remotely Operated Vehicle (ROV), in one preferred embodiment release mechanism 260 comprises a remotely operable release. One such release known in the art is operated by acoustics.

Chain 250 extends to recovery line assembly 240, which comprises a buoy 270 and a recovery line 280, with recovery line 280 preferably attached to anchor 10 at an attachment point on or near the upper end and generally centered on an upper end thereof. Recovery line assembly 240 additionally comprises a subsea connector 230 at its end distal from anchor 10. Such placement will generally ease removal of anchor 10 when desired, as it is essentially pulled back out of the seabed opposite its path into the seabed. A load line assembly 290 comprising a load line 300 and buoy 310 is attached to anchor 10. Preferably, load line 300 is attached at one end to anchor 10 at a point along the length of anchor 10 (for example, near the midpoint of the length of the anchor). The other end of load line 300 has a subsea connector 320 attached thereto. A buoy 310 is attached to the load line assembly, and holds subsea connector 320 above the seabed and accessible for later connection to a mooring line, as is later described. Load line assembly 290 is preferably connected to recovery line assembly 240 by a tether 340, which keeps load line assembly 290 attached to recovery line assembly 240 during deployment, but that can be disconnected by an ROV (or broken with relative ease by a load applied to the load line assembly, for example when a mooring line is connected to subsea connector 320 and a tension applied thereto).

Figure 20:
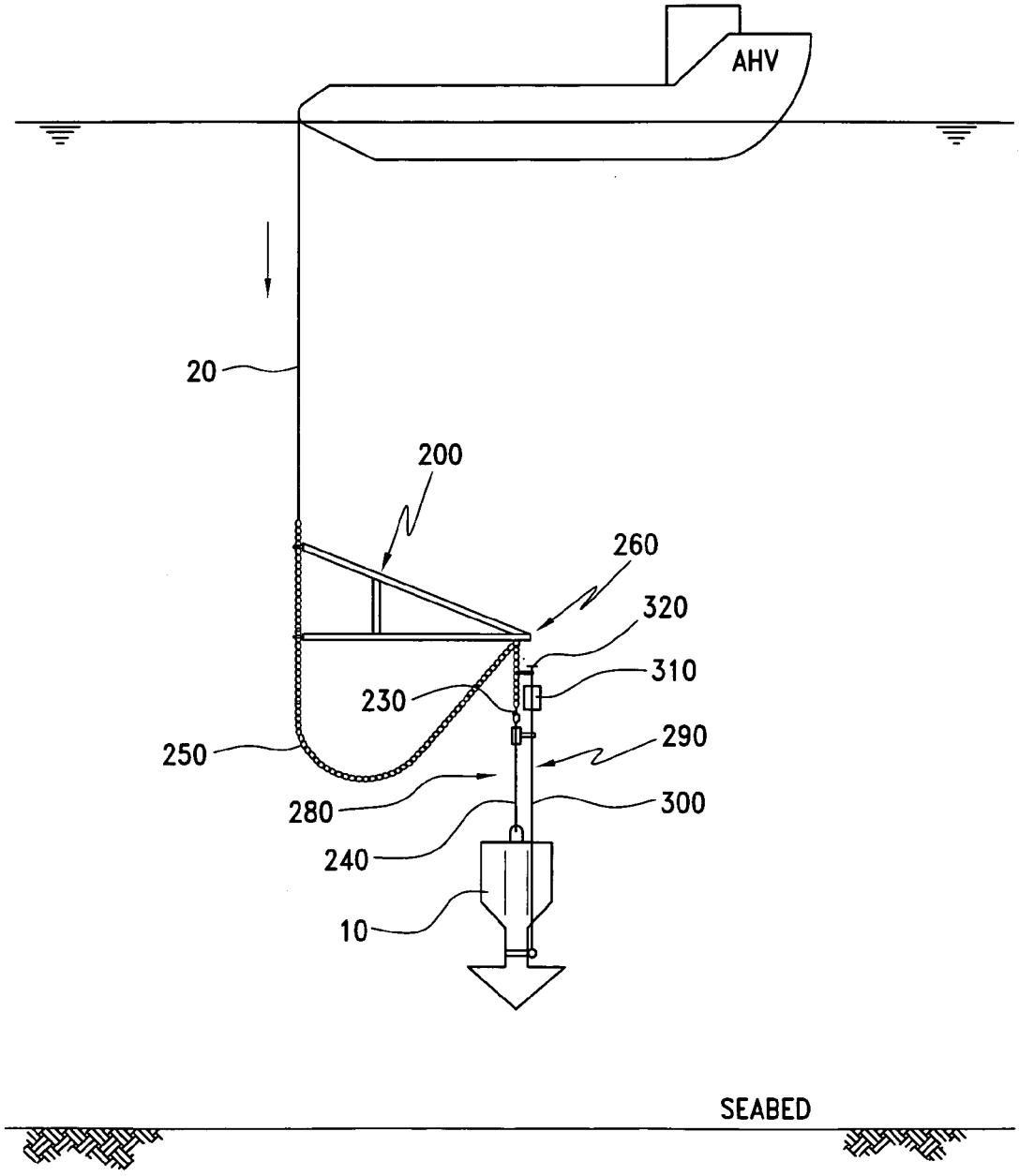
FIGS. 20 through 31 address another embodiment of the method and apparatus of the present invention.

FIG. 20, as described above, shows launch frame 200 lowered to a desired height above a seabed. While different applications will govern that height, by way of example only launch frame 200 may be positioned so as to place anchor 10 approximately 200 feet above the seabed (with a typical penetration depth after release of about 80 feet, distance of the nose of the anchor below the seabed).

Figure 21:
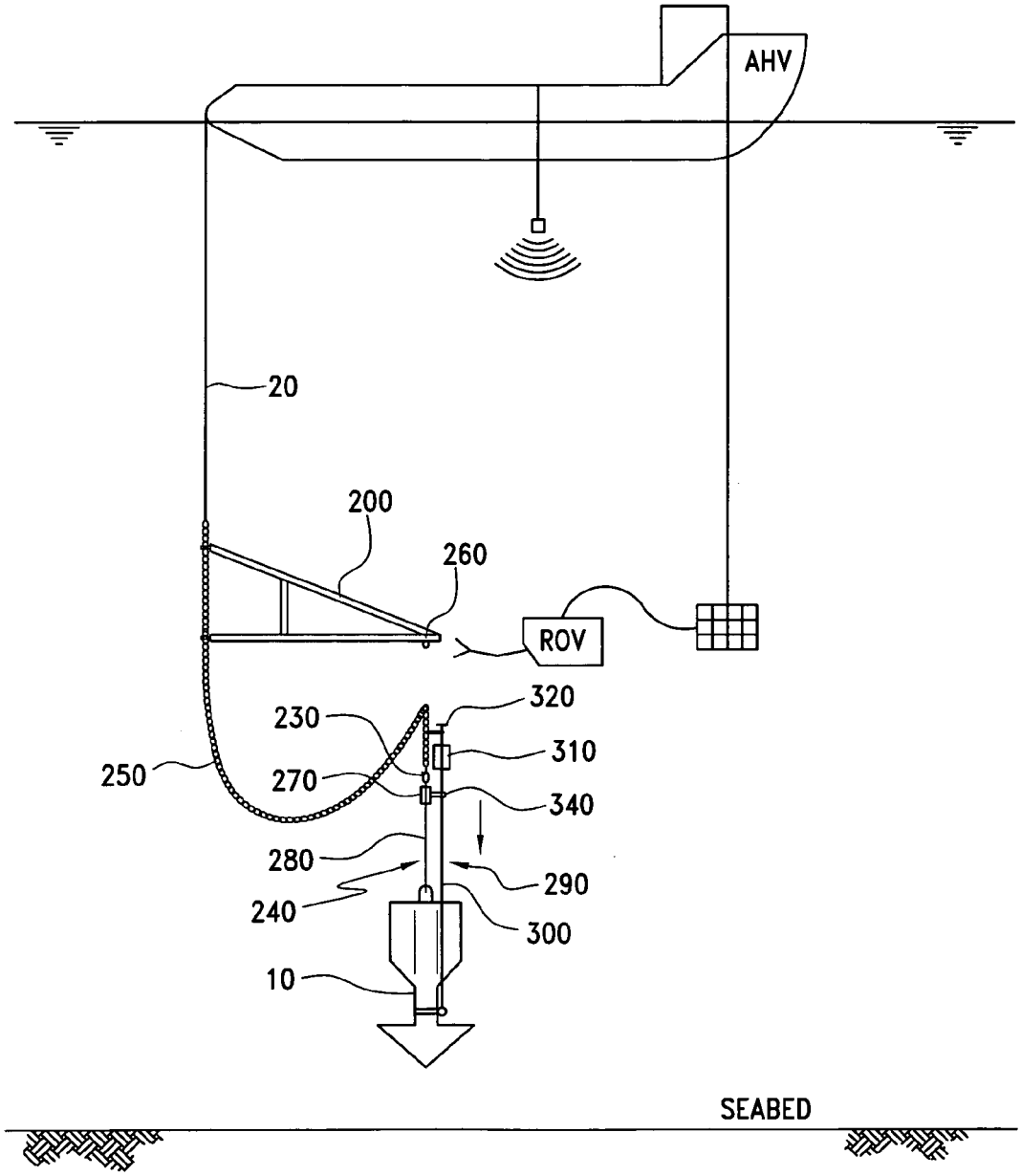
Figure 22:
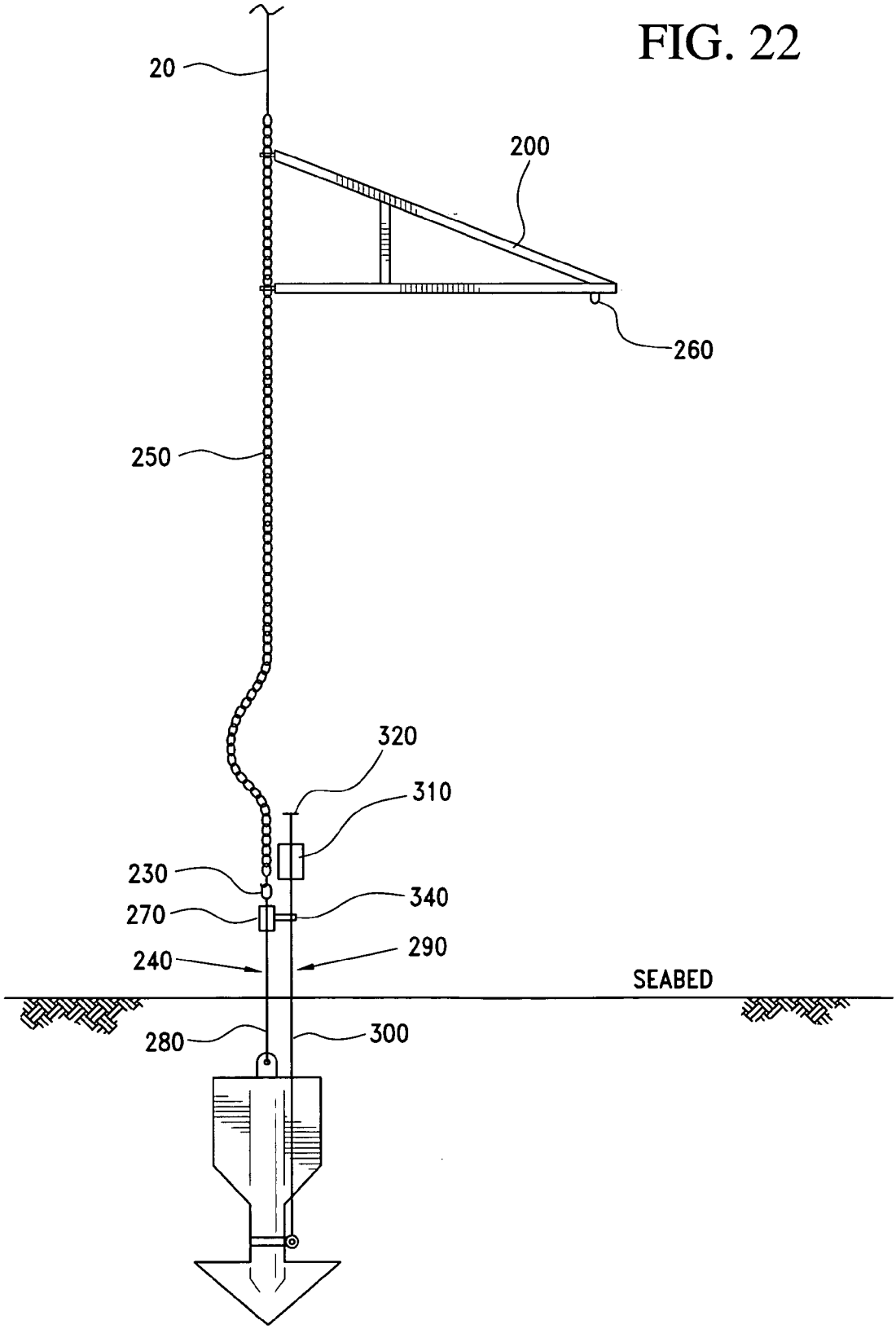
Figure 23:
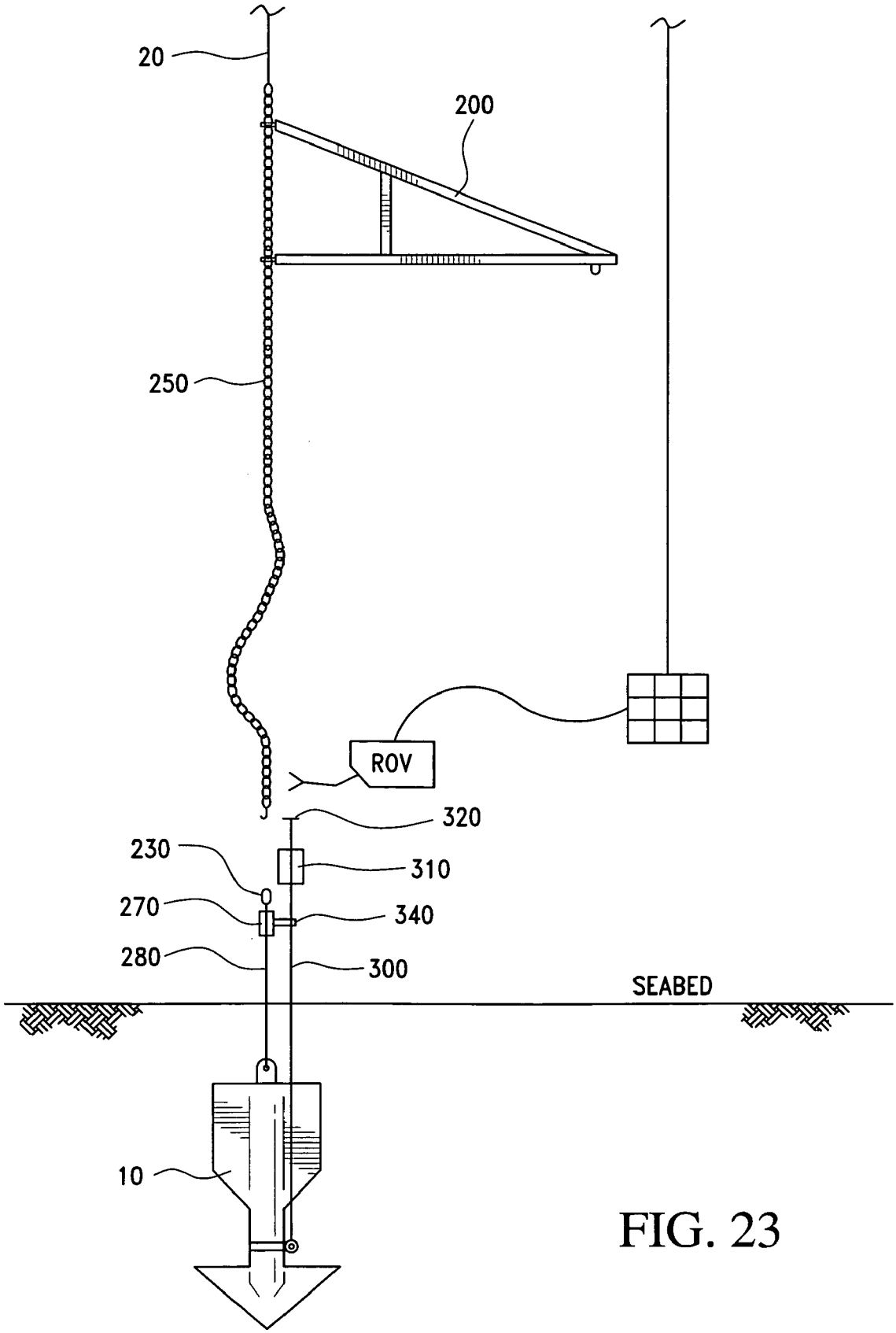
Figure 24:
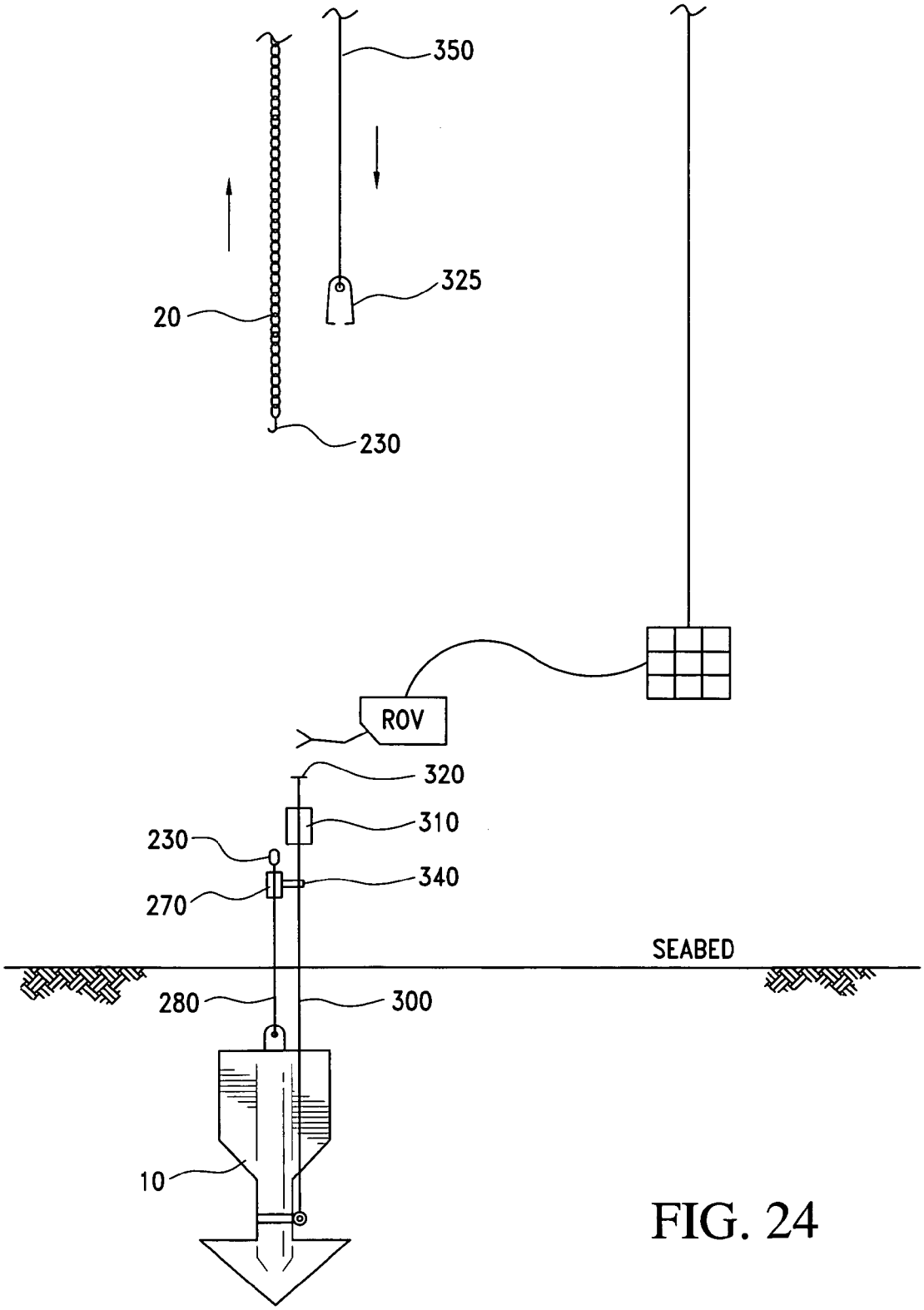
Figure 25:
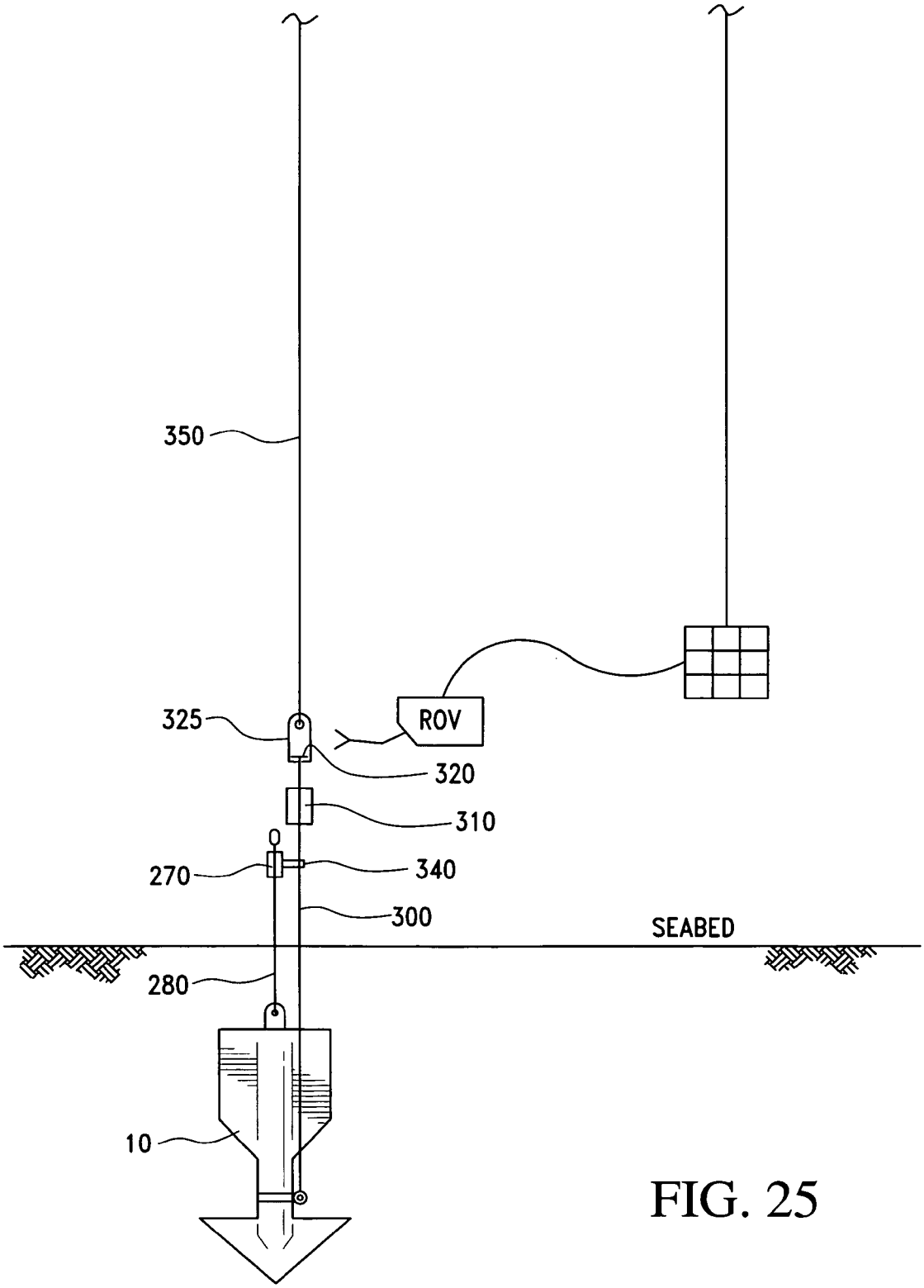
Figure 26:
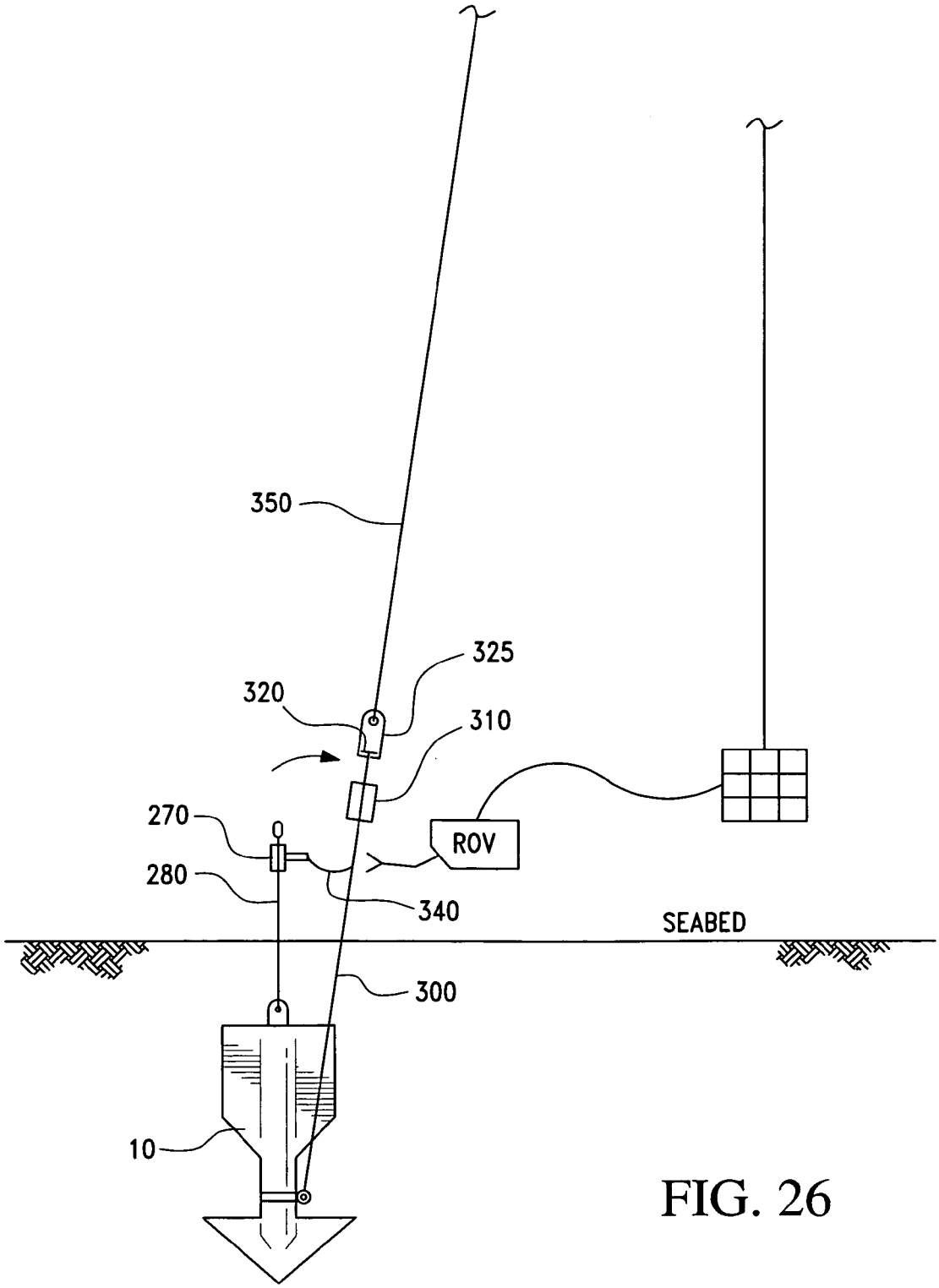
Figure 27:
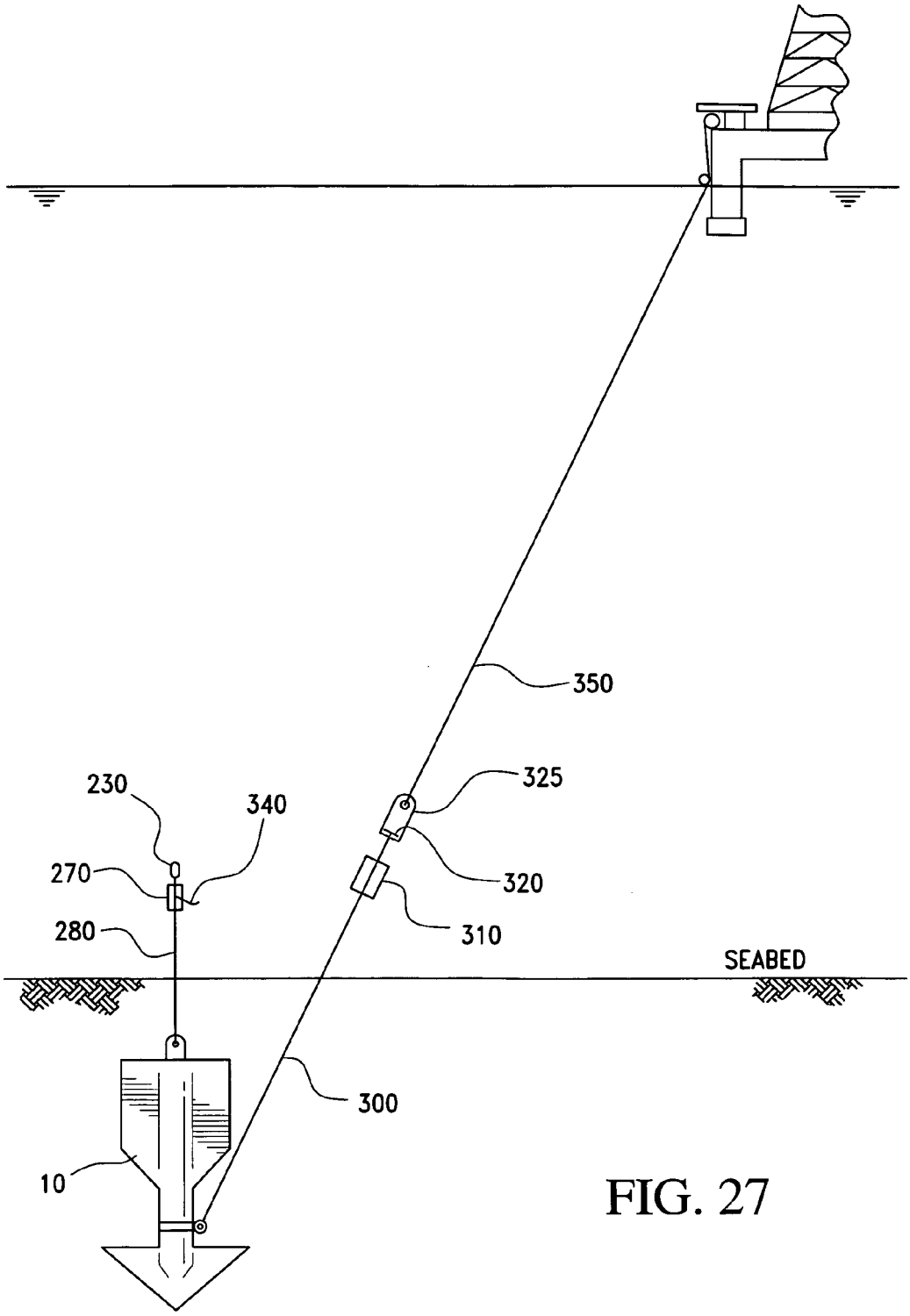
Figure 28:
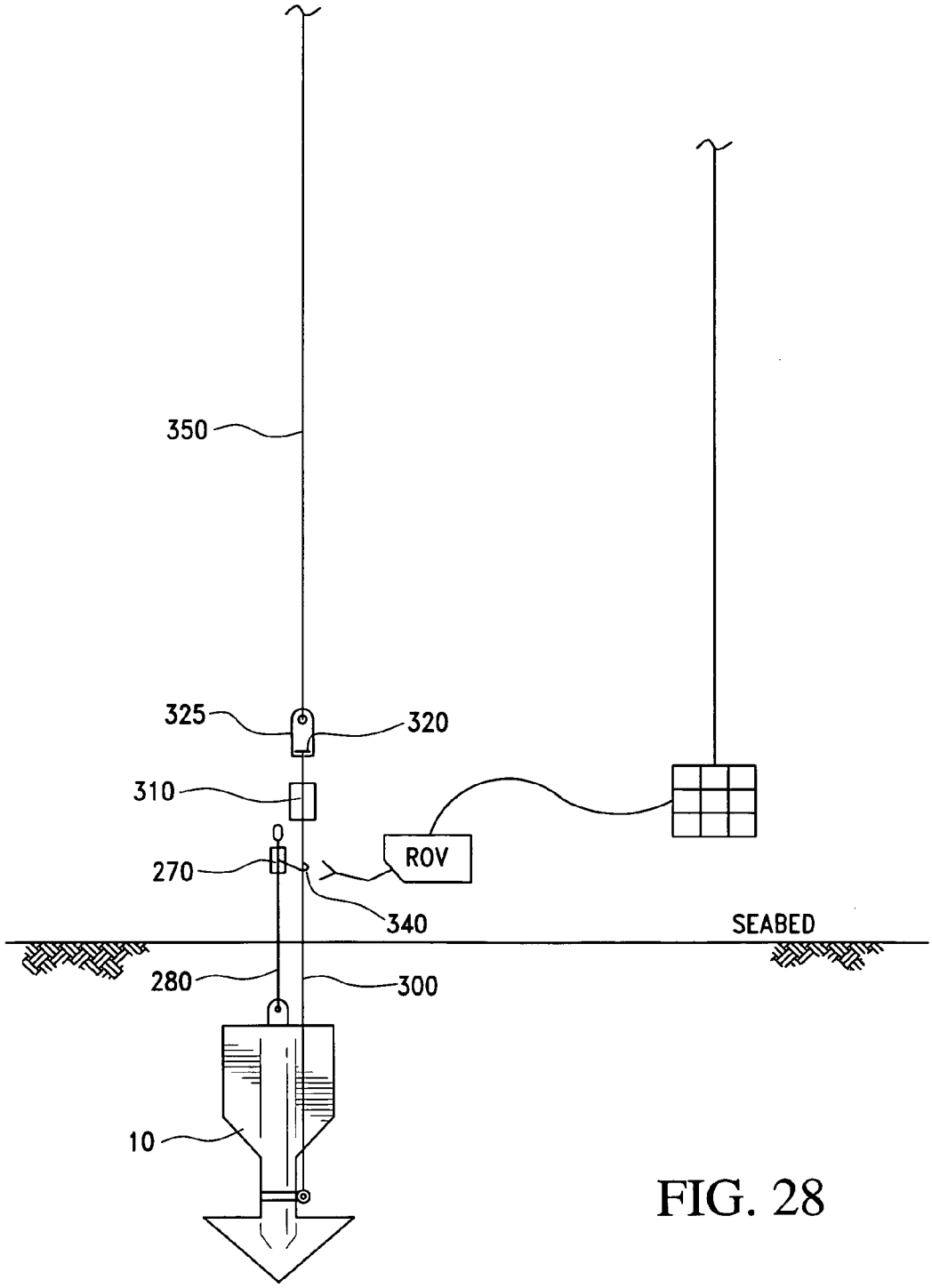
Figure 29:
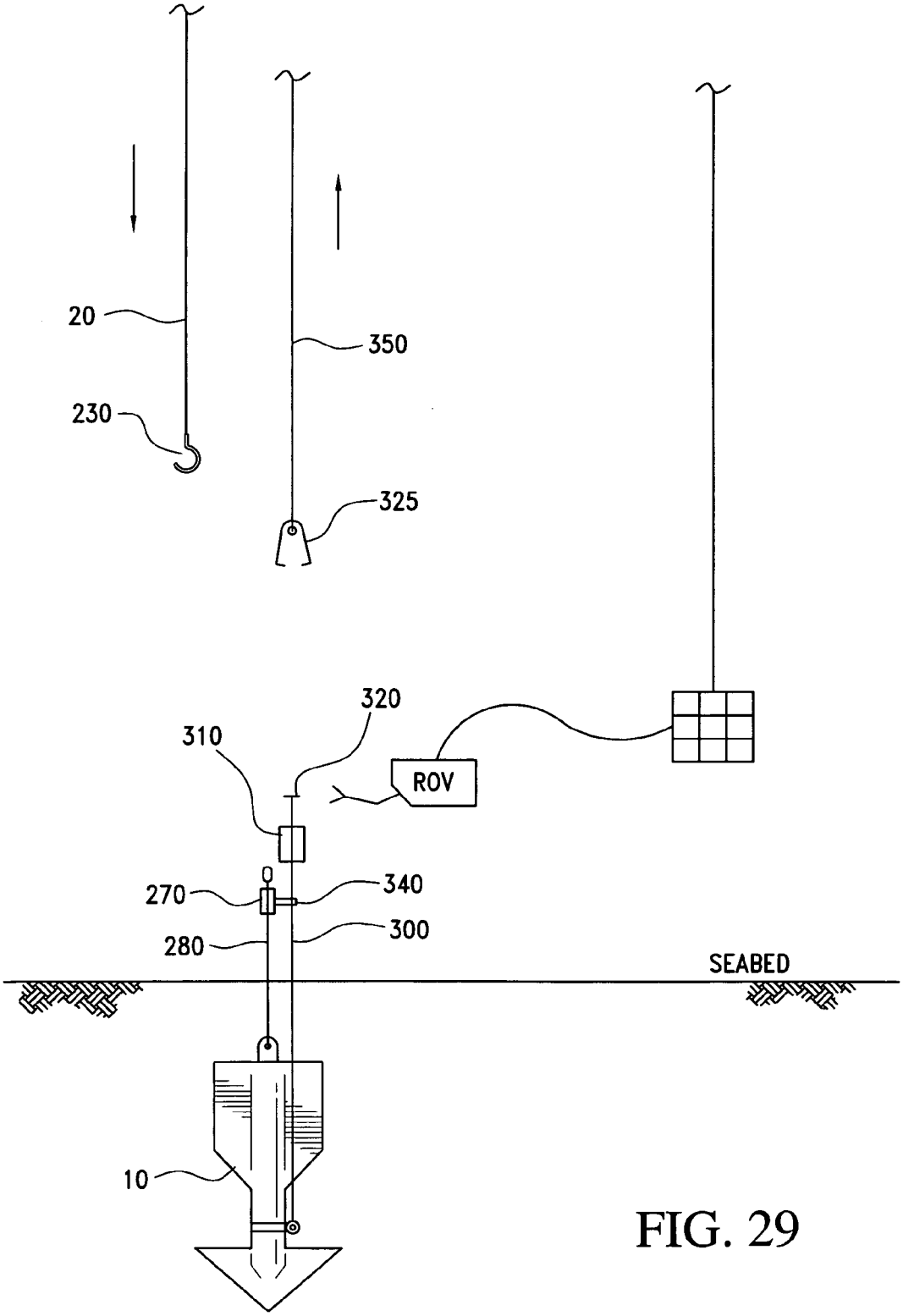
Figure 30:
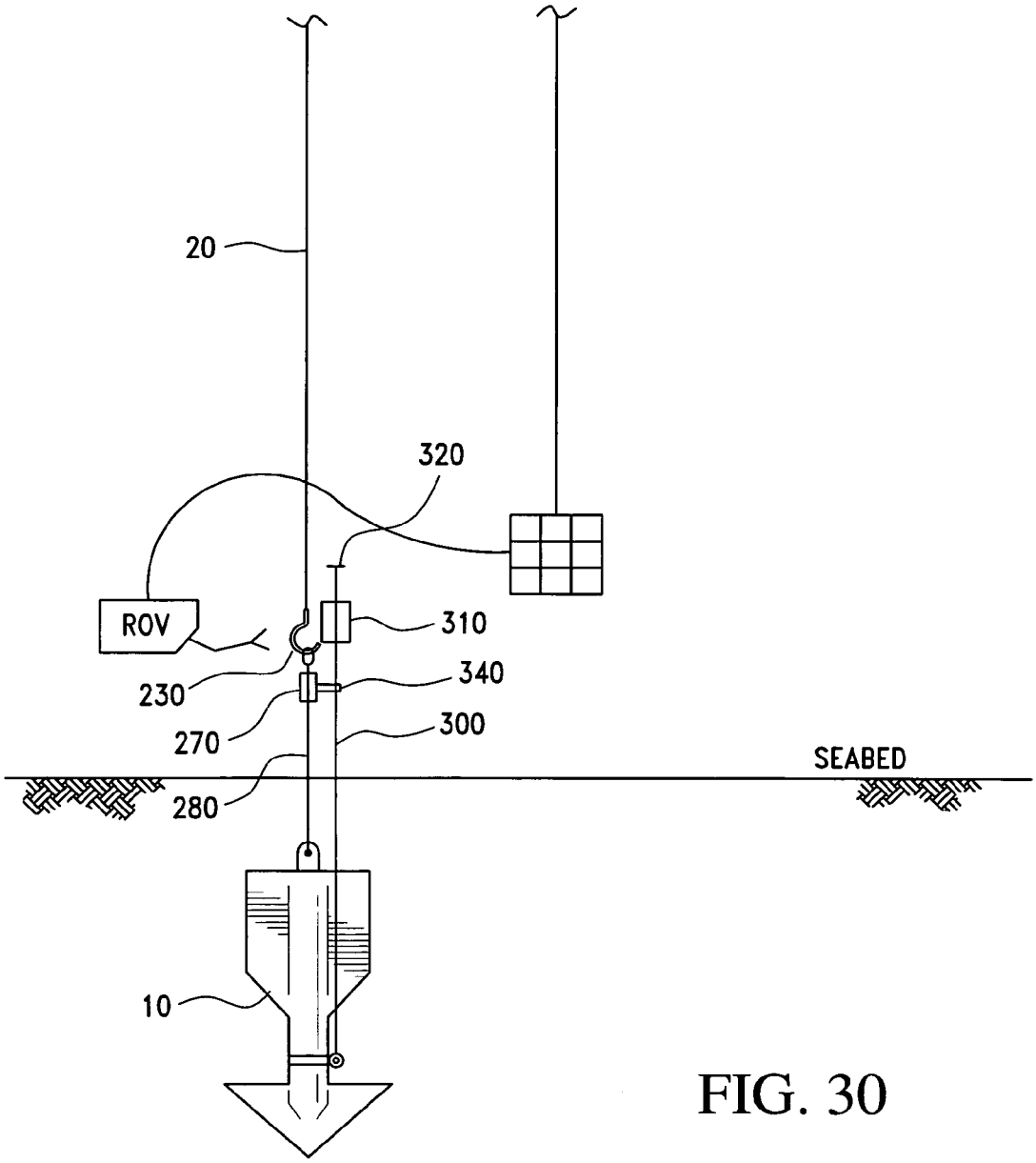
Figure 31:
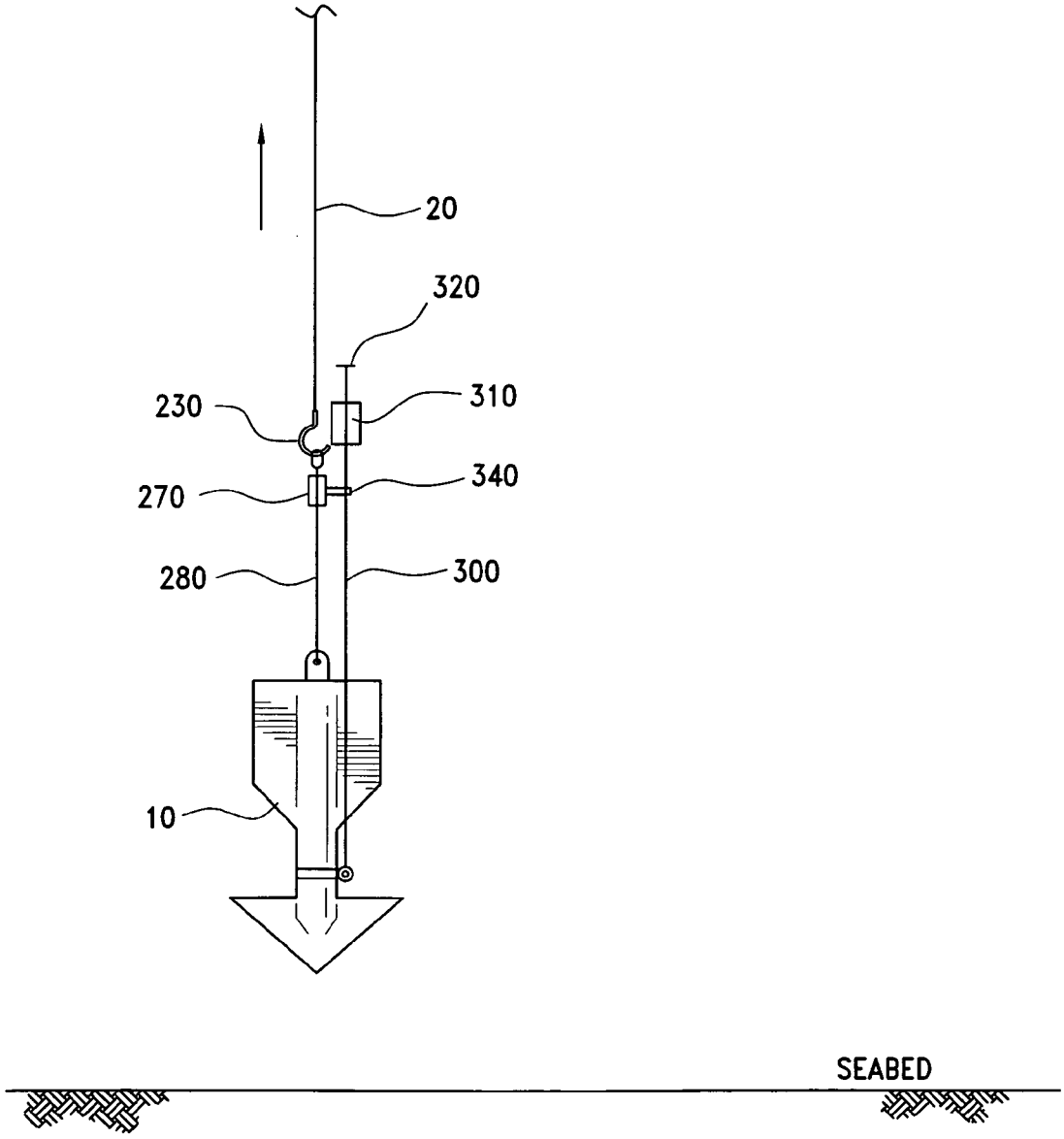

In FIG. 21, release mechanism 260 has been operated so as to permit anchor 10 to fall to the seabed under the force of gravity. FIG. 22 shows anchor 10 fully embedded. In FIG. 23, subsea connector 230 has been disconnected from recovery line assembly 240, and FIG. 24 shows the system as it would remain awaiting a mooring connection at some future time. In FIG. 25, a mooring line 350 (for example, from a mobile offshore drilling unit or other buoyant marine structure) has been connected to subsea connector 320 via subsea connector 325, and in FIG. 26 tether 340 has been undone by the ROV so that a tension can be placed on mooring line 350, which then assumes its loaded position shown in FIG. 27.

FIGS. 28 through 31 illustrate the reverse procedure of retrieving the anchor, comprising the steps of returning mooring line 350 to its initial position then applying tether 340; disconnecting mooring line 350 from load line assembly 290, and connecting lowering line 30, then pulling anchor 10 from the seabed via lowering line 20.

While the preceding description contains much specificity, it is understood that same is offered in order to illustrate some of the presently preferred embodiments of the invention, and not by way of limitation. Many changes could be made to the invention, and would be recognized by those having ordinary skill in the art, while not departing from the spirit of the invention. For example:

1. The subsea connectors 50, 55, 60, 110, 230, 320, and 325 can be simple hook-and-eye connectors, or can comprise male and female halves with mating and interlocking dovetail surfaces, as seen (by way of example only) in FIGS. 6, 9, and 10.
2. The recovery and load lines can be of cable, rigid rod, chain, or some combination thereof. In addition, both metals and non-metals (e.g., polyester and other fibers) can be used for these elements.
3. The methods and apparatus herein disclosed are suitable for use with any configuration of gravity installed anchor, in a wide range of water depths.
4. One or more than one anchors can be set, according to the present invention, in order to provide a desired mooring pattern for a given buoyant marine structure.

5. The retaining assembly 70 can take various forms: swinging arm, sliding pin, etc.
6. Release mechanism 260 can be a sliding pin and clevis or other mechanical arrangement known in the art; or can be an acoustic or other remotely operable mechanism.
7. In addition to mooring of floating marine structures, the inventions disclosed herein can also be used to moor fixed structures (that is, structures that are fixed to or setting on a seabed or other surface).
8. The method and apparatus herein disclosed is particularly suited to use with only a single vessel and a single deployment line. As can be seen in the figures and the accompanying description, only one anchor handling vessel is needed to bring the anchor assembly to a desired location, and the anchor assembly is deployed with only a single deployment (lowering) line. Such single vessel, single line deployment presents significant time and money savings. In addition, it is clear that recovery of the anchor after use may be done with only a single vessel, and a single recovery (lowering) line.
9. The anchor handling vessel AHV set out herein may be a conventional motor vessel, or alternatively may be a derrick barge or a fixed platform of some sort. The term AHV as used herein encompasses all of such possible vessels, platforms, etc.

Therefore, the scope of the invention is not confined to the examples given, but is limited only by the scope of the appended claims and their legal equivalents.

We claim:

1. A system for free fall placement of anchors, comprising:
a) an anchor;
b) a recovery line assembly comprising a recovery line attached at one end to said anchor, and a subsea connector attached to the other end thereof;
c) a load line assembly comprising a load line attached at one end to said anchor, and a subsea connector attached to the other end thereof;
d) a buoy attached to said recovery line assembly and said load line assembly, wherein said load line assembly is releasably held by said buoy by a release assembly; and
e) a release frame connected to a lowering line,
wherein said anchor, recovery line assembly, load line assembly, and buoy are releasably held by said release frame.

2. The system of claim 1, wherein said load line assembly is received within a groove in said buoy, and release assembly comprises a hinged arm on said buoy, movable between a first position blocking removal of said load line assembly from said groove, and a second position wherein said hinged arm is moved out of the path of said load line assembly.

3. The system of claim 2, wherein said buoy is held by said release frame by one or more retractable pins, adapted to be moved by an ROV, whereby when said pins are retracted said anchor is free to fall to a seabed.

4. A method of installing an anchor, and connecting a mooring line thereto, comprising the steps of:
a) providing an anchor assembly comprising:
i) an anchor;
ii) a recovery line assembly comprising a recovery line attached at one end to said anchor, and a subsea connector attached to the other end thereof;
iii) a load line assembly comprising a load line attached at one end to said anchor, and a subsea connector attached to the other end thereof;
iv) a buoy attached to said recovery line assembly and said load line assembly, wherein said load line assembly is releasably held by said buoy by a release assembly; and
v) a release frame connected to a lowering line,
wherein said anchor, recovery line assembly, load line assembly, and buoy are releasably held by said release frame;
b) lowering said release frame holding said anchor assembly until said anchor is a desired distance from a seabed;
c) releasing said anchor assembly from said release frame and permitting said anchor assembly to free fall to and into a seabed;
d) connecting a mooring line from a structure to said subsea connector on said load line;
e) releasing said load line assembly from said buoy; and
f) applying a desired tension on said mooring line.

5. The method of claim 4, wherein said step of lowering said release frame comprises lowering said release frame from a single vessel, and said release frame is lowered on a single line.

6. An apparatus for subsea placement of gravity-installed anchors, comprising:
a) a launch frame attached to a lowering line extending from a vessel and extending outwardly from said lowering line;
b) a release mechanism attached to said launch frame at a location displaced from said lowering line;
c) a flexible member extended from said lowering line to said release mechanism, and then to a subsea connector;
d) a recovery line assembly comprising a recovery line and a subsea connector attached to said subsea connector on said lowering line and attached to an anchor;
e) a load line assembly comprising a load line attached at one end to said anchor and having a subsea connector attached to the other end, said load line assembly releasably joined to said recovery line assembly.

7. The apparatus of claim 6, further comprising:
a) a buoy attached to said recovery line assembly and said load line assembly.

8. The apparatus of claim 6, wherein said release mechanism comprises a pin and clevis, adapted to be manipulated by an ROV.

9. The apparatus of claim 6, wherein said release mechanism comprises a remotely operable acoustic release.

10. A method of installing an anchor and connecting a mooring line thereto, comprising the steps of:
a) providing an apparatus comprising:
i) a launch frame attached to a lowering line extending from a vessel and extending outwardly from said lowering line;
ii) a release mechanism attached to said launch frame at a location displaced from said lowering line;
iii) a flexible member extended from said lowering line to said release mechanism, and then to a subsea connector;
iv) a recovery line assembly comprising a recovery line, a buoy, and a subsea connector attached to said subsea connector on said lowering line and attached to an anchor;
v) a load line assembly comprising a load line attached at one end to said anchor and having a subsea connector attached to the other end, said load line assembly releasably joined to said recovery line assembly;
b) lowering said apparatus to a position wherein said anchor is at a desired height above a seabed;

c) actuating said release mechanism so as to permit said anchor to commence free fall to and into said seabed;

d) disconnecting said subsea connector joining said lowering line and said recovery line;

e) attaching a mooring line from a structure to said subsea connector on said load line; and f) applying a desired tension to said mooring line.

11. The method of claim 10, wherein the step of lowering said apparatus to a position wherein said anchor is at a desired height above a seabed comprises lowering said apparatus from a single vessel, and said apparatus is lowered on a single line.

* * * * *